US007708302B2

(12) United States Patent
Wilson

(10) Patent No.: US 7,708,302 B2
(45) Date of Patent: May 4, 2010

(54) SNOWBOARDS

(75) Inventor: Anton F. Wilson, Glengarry Rd., Croton-on-Hudson, NY (US) 10520

(73) Assignee: Anton F. Wilson, Croton-on-Hudson, NY (US)

( * ) Notice: Subject to any disclaimer, the term of this patent is extended or adjusted under 35 U.S.C. 154(b) by 433 days.

(21) Appl. No.: 11/276,149

(22) Filed: Feb. 15, 2006

(65) Prior Publication Data

US 2006/0226613 A1 Oct. 12, 2006

Related U.S. Application Data

(60) Provisional application No. 60/653,103, filed on Feb. 16, 2005, provisional application No. 60/751,089, filed on Dec. 16, 2005.

(51) Int. Cl.
*A63C 5/07* (2006.01)

(52) U.S. Cl. ..... 280/602; 280/11.14

(58) Field of Classification Search ..... 280/602, 280/601, 607, 609, 11.14
See application file for complete search history.

(56) References Cited

U.S. PATENT DOCUMENTS

| | | | | | |
|---|---|---|---|---|---|
| 1,101,631 | A * | 6/1914 | Jaoques | 280/605 |
| 3,260,531 | A * | 7/1966 | Heuvel | 280/602 |
| 3,797,839 | A * | 3/1974 | Smolka et al. | 280/617 |
| 4,067,593 | A | 1/1978 | Earl | 280/617 |
| 4,565,386 | A * | 1/1986 | Crainich | 280/602 |
| 5,284,357 | A * | 2/1994 | Tinkler | 280/602 |
| 5,301,976 | A * | 4/1994 | Stepanek et al. | 280/602 |
| 5,332,252 | A * | 7/1994 | Le Masson et al. | 280/602 |
| 5,395,132 | A * | 3/1995 | Abondance et al. | 280/607 |
| 5,437,468 | A * | 8/1995 | Schenner | 280/602 |
| 5,597,170 | A | 1/1997 | Le Masson et al. | 280/602 |
| 5,758,894 | A * | 6/1998 | Maggiolo | 280/602 |
| 5,775,716 | A * | 7/1998 | Harsanyi et al. | 280/602 |
| 5,820,154 | A * | 10/1998 | Howe | 280/602 |
| 5,845,923 | A * | 12/1998 | Zanco | 280/607 |
| 5,915,719 | A * | 6/1999 | Bauvois | 280/607 |
| 5,927,743 | A * | 7/1999 | Mantel | 280/602 |
| 6,158,747 | A * | 12/2000 | Magnani | 280/11.14 |
| 6,619,688 | B2 * | 9/2003 | Billon et al. | 280/607 |
| 6,779,810 | B1 * | 8/2004 | Mangold | 280/634 |
| 6,834,881 | B2 | 12/2004 | Mash | 280/607 |
| 6,857,653 | B2 * | 2/2005 | Wilson | 280/602 |
| 6,883,823 | B2 * | 4/2005 | Riepler et al. | 280/602 |
| 7,134,680 | B2 * | 11/2006 | Emig et al. | 280/602 |

(Continued)

OTHER PUBLICATIONS

Notification of Transmittal of International Search Report and Written Opinion of the International Searching Authority, or the Declaration from PCT/US06/05243, dated Feb. 15, 2006.

(Continued)

*Primary Examiner*—Jeffrey J Restifo
(74) *Attorney, Agent, or Firm*—Fish & Richardson P.C.

(57) ABSTRACT

Snowboards are provided that consolidate and redirect a portion of the weight and forces of the rider to the optimal locations (near the edges and near the longitudinal center of the board), providing excellent turning and control and providing impact absorption when landing from a jump. In some implementations, an adjustable spring suspension system allows custom optimization of both the turning and ride characteristics of the snowboard.

1 Claim, 17 Drawing Sheets

U.S. PATENT DOCUMENTS

| | | | | |
|---|---|---|---|---|
| 7,281,729 | B1 * | 10/2007 | Wilson | 280/602 |
| 7,296,818 | B2 * | 11/2007 | Krumbeck et al. | 280/607 |
| 2004/0084879 | A1 | 5/2004 | Wilson | 280/608 |
| 2004/0232656 | A1 | 11/2004 | Gyr | 280/617 |
| 2005/0104328 | A1 * | 5/2005 | Emig et al. | 280/602 |
| 2005/0206128 | A1 * | 9/2005 | Gignoux | 280/602 |
| 2006/0145451 | A1 * | 7/2006 | Wilson | 280/602 |

OTHER PUBLICATIONS

Communication from a foreign patent office in a counterpart applicaton (Int'l. Search Report from Int'l. App. No. PCT/US05/42129), dated May 21, 2007.

* cited by examiner

SNOWBOARDS

CROSS-REFERENCE TO RELATED APPLICATIONS

This application claims benefit from U.S. Provisional Patent Application Nos. 60/653,103, filed Feb. 16, 2005, and 60/751,089, filed Dec. 16, 2005. The entire contents of both provisional applications are incorporated by reference herein.

TECHNICAL FIELD

This disclosure relates to snowboards.

BACKGROUND

A snowboard depends upon the same basic turning principles as those of an alpine ski. Both the snowboard and ski are designed with a significant "side cut" along the length of the longitudinal edges (FIG. 1). Specifically, the side-to-side width of a ski and snowboard are greatest at the front and back, while diminishing to a minimum at the "waist" or midsection. When a ski is tipped onto an edge, the wider tip and tail will engage the snow and tend to lift the narrow midsection off the snow (FIG. 2). Because the weight of the skier is concentrated at the center of the ski, this central force will bend the ski into a convex curve until the narrow midsection touches the snow. It is the bending of the ski into this arc that creates the "turn" (FIGS. 3A and 3B). Ideally, the bending force is applied to the middle (where the ski binding is mounted) while the ends of the ski are supported by the snow (FIG. 4), a dynamic similar to that of an archery bow where the center is pushed by the archer while the ends are pulled on by the bowstring.

Conventional snowboards, however, do not utilize this ideal bending dynamic. When a conventional snowboard is tipped onto an edge, the wide tip and tail engage the snow in the same manner as previously described for a ski. However, the weight/force of the snowboarder is not applied at the optimal narrow longitudinal center point. Instead, this force is bifurcated to the two boot binding positions, which are located at approximately one-third of the total length of the snowboard from each end (FIG. 5).

This creates several undesirable and counterproductive effects. Most evident is the fact that the snowboard will be more difficult to bend, and turn, because the force is not being applied at the optimal center location. With the feet positioned at these two locations, the board will assume a flat or even negative (concave) shape between the boot bindings. Thus, instead of one continuous convex arc, the board will tend to assume two minor convex arcs separated by a concave arc or flat spot (FIG. 5A), which is totally counterproductive to efficient turning. FIG. 6A shows the actual profile that the snowboard tends to assume during a turn, while FIG. 6B illustrates the desired, theoretical "perfect turn."

Another undesirable effect of conventional snowboard design is the lack of any means to absorb energy and shock. Thus upon landing from a jump, the rider's body and feet must absorb the total impact.

SUMMARY

In general, the invention features snowboards that consolidate and redirect bending forces, providing excellent turning and control and allowing the snowboarder to have a more comfortable, less awkward stance while turning. Bending forces may be redirected to the edges and longitudinal center of the board.

In some implementations, the snowboard is configured to partially absorb the energy of impact that is generated when landing from a jump. A supplementary suspension system may be included to further redistribute forces along the length of the snowboard, thereby optimizing the flex pattern and contact characteristics of the snowboard. In some cases, the suspension is adjustable, allowing the characteristics of the snowboard to be varied to suit a wide variety of terrain, snow conditions and snowboarder abilities/interests. The suspension system may be employed to redistribute forces to the center area of the snowboard, while supplementary components can also be included to further redistribute forces to the longitudinal edges of the snowboard, thereby optimizing the flex pattern and contact characteristics of the snowboard. The suspension system can be integrated into a snowboard as part of the original design and fabrication, or in some implementations it can be attached to an existing standard snowboard at any time.

In one aspect, the invention features a snowboard including a snowboard body, having an upper surface and a lower surface, the lower surface being constructed to slide on snow; and mounted on the upper surface of the snowboard body, a boot binding mounting and suspension system comprising a generally horizontal mounting platform defining boot/binding mounting locations, attached to the snowboard body in a manner that maintains a clearance distance between the mounting platform and the snowboard body in the area under the boot/binding mounting locations.

Some implementations include one or more of the following features. The platform is mounted on the snowboard body in a longitudinally central location. The snowboard further includes a pair of boot bindings affixed directly to the platform. The clearance distance is sufficiently large so as to allow the snowboard body to curve up or down into an arc while the mounting platform remains essentially flat. The platform is resilient and includes an upward camber, allowing the platform to bend so as to ease impact when landing. The platform is mounted on the snowboard body by one or more suspension beams. The platform includes two portions. The snowboard further includes a pitch control system configured to allow opposite ends of the snowboard body to arc upward in unison unimpeded, but inhibits non-uniform movements or movements in opposite directions of the ends. The snowboard further includes a spring suspension system, which may be configured to apply a portion of the weight of the rider to the snowboard body at one or more distinct points in addition to the points where the platform is attached to the snowboard body. The spring suspension system applies a portion of the weight of the rider to the snowboard body at one or more distinct points located in the central longitudinal fifth of the snowboard body. The spring suspension system applies a portion of the weight of the rider to the snowboard body at one or more distinct points located longitudinally a distance from the longitudinal center of the snowboard equal to from 10% to 30% of the full longitudinal length of the snowboard body. The spring suspension system applies a portion of the weight of the rider to the snowboard body at one or more distinct points located longitudinally a distance from the longitudinal center of the snowboard equal to from 30% to 50% of the full longitudinal length of the snowboard body. The snowboard bindings are pivotally mounted to allow them to cant about an axis generally parallel to the long axis of a snowboarder's boot during use.

In a further aspect, the invention features a snowboard including (a) a snowboard body, having an upper surface and a lower surface, the lower surface being constructed to slide on snow; (b) mounted on the upper surface of the snowboard body, a boot binding mounting and suspension system comprising a generally horizontal mounting platform defining boot/binding mounting locations; and (c) a pitch control system including two compressible/extendable elements located between the mounting platform and snowboard body in areas where the snowboard body is free to arc independently of the mounting platform.

In another aspect, the invention features a snowboard including (a) a snowboard body, having an upper surface and a lower surface, the lower surface being constructed to slide on snow and the upper surface defining boot/bindings mounting locations; and (b) on the upper surface of the snowboard body, a device attached to the snowboard body in the vicinity of each of the two boot/binding mounting locations, the device being configured to apply a downward force to the longitudinal center area of the snowboard body.

In some implementations, the device comprises a spring. The device may include a substantially rigid beam and, mounted on the beam, a spring element configured to create the downward force. The spring element may be configured to be adjustable for pressure and vertical position. In some implementations, the device pushes the center of the snowboard body into a longitudinal reverse camber contour. In some implementations, the device is configured such that, while the snowboard is supported from above at the two boot binding positions only, and an upward force is applied to the center of the lower surface of the snowboard causing the lower surface to deflect upward, the additional force required for an additional millimeter of deflection from a first specified point of deflection will be greater than the additional force required for an additional millimeter of deflection from a specific second point of deflection that is greater than the first.

In an alternate implementation force redistribution to the center is accomplished by incorporating a unique longitudinal bottom surface shape into the snowboard body that includes an area of reverse camber in the vicinity of the center.

The details of one or more implementations of the invention are set forth in the accompanying drawings and the description below. Other features, objects, and advantages of the invention will be apparent from the description and drawings, and from the claims.

DETAILED DESCRIPTION

Figure 8A:
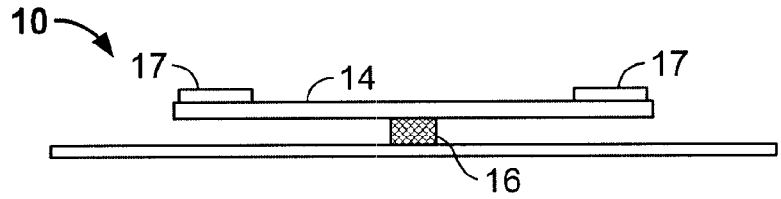
FIGS. 8A and 8B are diagrammatic side views of snowboards according to two implementations of the invention.
Figure 8B:
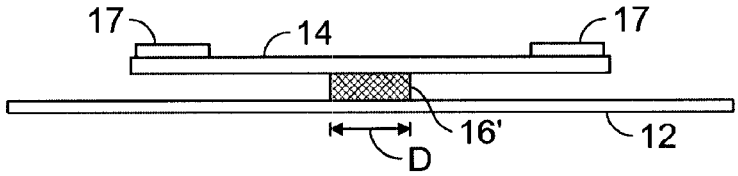
Figure 8C:
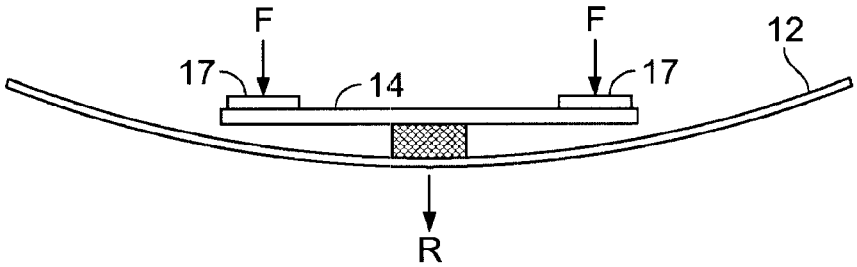
FIG. 8C is a diagram showing the resulting force on the snowboard of FIG. 8A or 8B when force is applied to the snowboard bindings.

Referring to FIG. 8A, a snowboard 10 includes a body 12 and, mounted on the body 12, a platform 14. Platform 14 is mounted on the body 12 by one or more supporting beams 16, as will be discussed below. The platform 14 is configured to receive a pair of snowboard bindings 17. Referring to FIG. 8C, the forces exerted by the snowboarder's feet on bindings 17 (arrows F) are redirected by the platform and mounting structure (the supporting beam(s) discussed below) to the approximate longitudinal midpoint of the body 12 (arrow R). As discussed above, the longitudinal midpoint is the optimal location for force to be applied when turning.

The body 12 has a lower surface that is constructed to slide over a snow surface. The lower surface may be formed, for example, of high density polyethylene (HDPE), a blend of HDPE with graphite, or other hard materials having a relatively low coefficient of friction. The body 12 has a semi-rigid construction that will allow the board to flex into an arc when supported at its longitudinal extremities and pressured in the center, and includes hard edges, e.g., of steel, around its perimeter. The length of the body is generally approximately 4-7 times the maximum width of the body. The width is maximum at each end, tapering to a minimum width at the approximate center that is typically 70% to 90% of the maximum width. Typically, the maximum width is from about 9 to 13 inches and the length is from 4 to 6 feet.

The platform is spaced above the top surface of the body a sufficient distance to allow enough clearance to allow the body 12 to flex upward into an arc without the body hitting the platform 12 or supporting beams. Because there is sufficient clearance between the body and the binding platform, the body is free to flex into a perfect convex arc below the snowboarder's feet without forcing the boarder's legs into an awkward angle. Thus, the snowboarder can focus on optimal balance positioning without being encumbered by angular movement of the boot bindings. Typically, the platform is spaced above the top surface a distance D of approximately 0.75 inch to 3 inches, e.g., 1.2 inch to 1.5 inch. The platform is mounted on the body at approximately the longitudinal midpoint of the body. Preferably, the platform is mounted exactly at the longitudinal midpoint, but can be slightly to one side or the other, e.g., within 1-2 inches of the midpoint. The longitudinal midpoint typically coincides with the structural center of the body and the point of least width. The platform may be mounted on a single longitudinally narrow supporting beam 16' at or close to the longitudinal midpoint (FIG. 8A). Alternatively, the platform may be mounted on a pair of narrow supporting beams spaced from each other, a short distance fore and aft of the longitudinal midpoint (not shown), or on a single longitudinally wider supporting beam 16 (FIG. 8B), to spread the contact area over a short distance D fore and aft of the approximate midway point. Spreading the contact area will decrease the bending moment on the supporting beam which may increase the robustness of the platform/beam/body assembly.

Figure 9A:
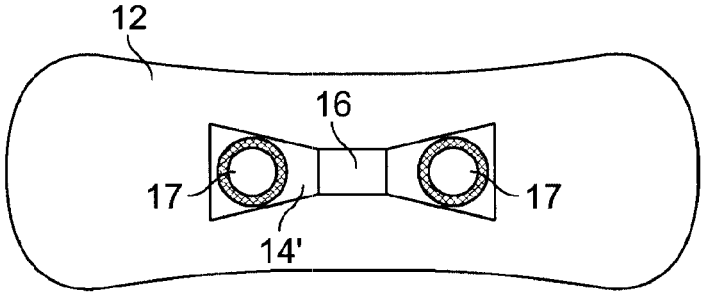
FIG. 9A is a top view of a snowboard according to another implementation of the invention.
Figure 9B:
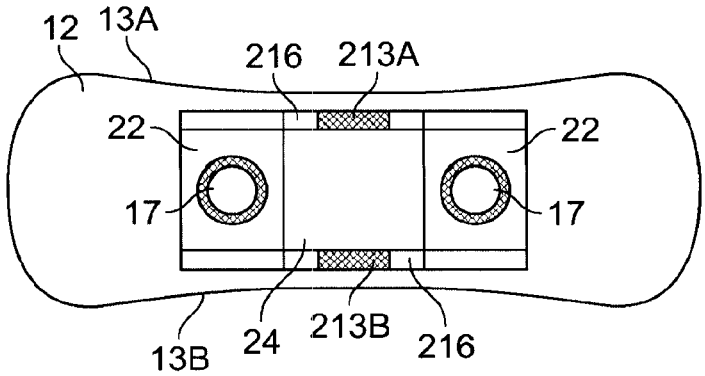
FIGS. 9B-9E are top and side views, respectively, of yet another implementation.
Figure 9C:
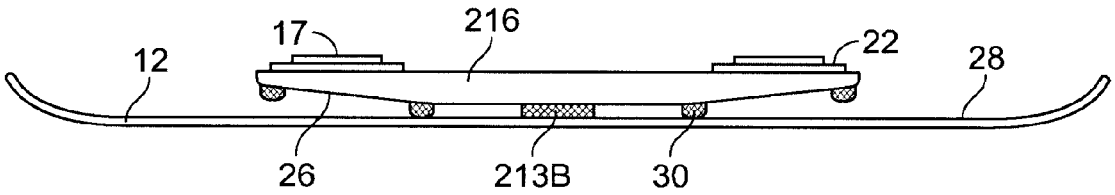

Similarly, in the widthwise direction the platform can be supported by a single centrally-located supporting beam 16 (FIG. 9A). If desired, in this case the platform 14 may have a "bowtie" shape, as shown, or an hourglass shape. Alternatively, as shown in FIG. 9B, edge control can be enhanced by providing two supporting brackets 213A, 213B, positioned close to the two respective longitudinal edges 13A, 13B of the body 12. In this case, the continuous platform 14 may be replaced by a pair of elongated structural members 216 that support foot pads 22 on which bindings 17 are mounted. This configuration provides an open area 24, thereby reducing the overall weight of the snowboard. Preferably, as shown in FIG. 9C, the lower surface 26 of each elongated structural member 216 is curved, so that the central portion of the structural member is relatively thick and the ends are relatively thinner. This curvature allows for clearance between the lower surface 26 and the upper surface 28 of snowboard body 12 so that the snowboard body can flex and arc freely. If desired, multiple supporting beams may be positioned across the width of the body (not shown). Moreover, in some implementations the central portion of each elongated member can be mounted directly to the upper surface 28 of the snowboard body and support brackets 213A, 213B eliminated.

The platform is generally relatively rigid, i.e., sufficiently rigid so that the ends of the platform, when carrying the weight of a rider weighing approximately 200 lbs, will not deviate more than 0.125 inch from their unstressed positions. Platforms having this degree of rigidity may be constructed, for example, of aluminum or lightweight composite materials. However, in some implementations, e.g., for snowboards that will be used for jumping and stunts, the platform may be resilient and include a slight upward camber or arc, allowing the platform to act as a springboard to ease impact when landing. In this case, the platform material is selected so that the ends of the platform would deflect up to 0.5 inch or more under severe loads.

Some snowboard maneuvers entail placing a majority of weight and force on one foot or the other. In such cases, it is desirable to transmit such imbalanced forces directly to the snowboard under the respective boot binding that is being favored. This is contrary to the balanced flex pattern, discussed above, that facilitates turning. In other words, the snowboard should be free to flex into an arc beneath the boot bindings if the two feet are evenly pressured for a pure turn, but the boot binding should feel directly connected to the snowboard beneath if the binding is inordinately weighted for a specific non-turning maneuver.

Figure 9D:
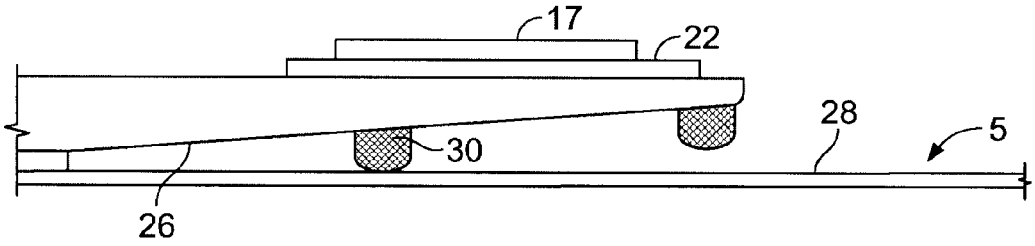
Figure 9E:
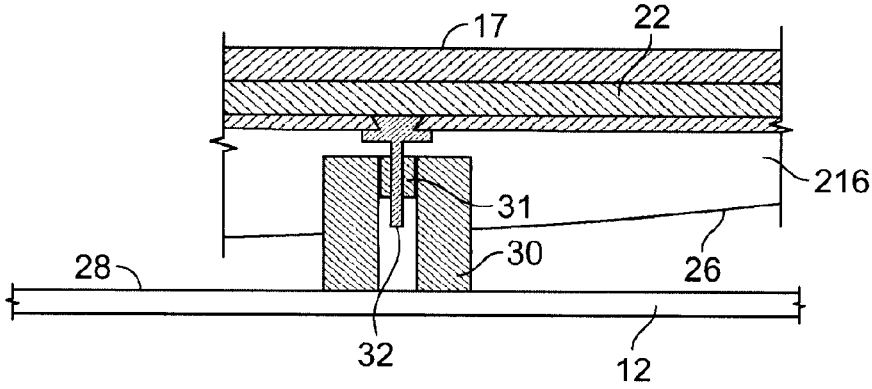

To accommodate such imbalanced forces a system of spring-like elements can be included in the suspension system. Such a system is illustrated in FIG. 9C-D, where spring-like elements 30 are mounted to the beam 216 at two or more locations. These springs can be elastomers that include an integral threaded component 31 that screws onto a threaded stud 32 mounted to the beam 216. The elastomers 30 will contact the top of the snowboard body 28 as it curves upward into an arc. The durometer, spring rate, and the contact height of the elastomer 30 can be selected to have a minimal effect on the loading of the snowboard body 12 during a balanced turn, yet transfer a significant load to the snowboard body 12 during a maneuver that places an inordinate percentage of the riders weight on only one leg. Suitable elastomers include polyurethane, neoprene, buna rubber and mixtures thereof. In some implementations, the elastomer will have a hardness of about 50 to 80 Shore A, e.g., about 60 to 70 Shore A.

Figure 10:
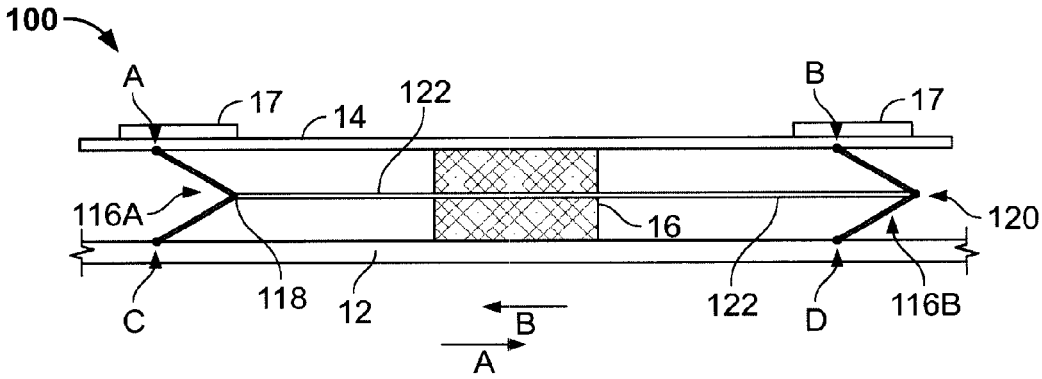
FIGS. 10 and 11 are side views of snowboards including alternative pitch control systems.

The snowboard may alternately be provided with a pitch control system. A snowboard 100 including such a system is shown in FIG 10. This system allows the snowboard body 12 to freely flex into an arc when evenly pressured by both feet for a turn, yet creates a direct stiff connection between the snowboard body and a boot that is inordinately pressured. Scissor-like linkages 116A, 116B connect the platform and body beneath each boot binding 17. These linkages are pivotally mounted to the platform 14 at pivot points A and B, and pivotally mounted to the snowboard body 12 at pivot points C and D. Linkages 116A, 116B are oriented in a common direction, and the knee pivot 118 of the left-hand linkage 116A is connected to the knee pivot 120 of the right-hand linkage 116B by a stiff connecting rod 122.

When pressured evenly with both feet, the body 12 flexes freely as both linkages 116A and 116B compress and both knee pivots move forward (arrow A) in unison. The system is in essence transparent and presents no impediment to the flex that facilitates an easy turn. On the other hand, if a majority of weight is placed on one boot only, the linkage under that boot will want to compress (knee pivot forward—arrow A) while the linkage under the unweighted boot will want to extend (knee pivot rearwards—arrow B). Because a solid rod connects the two knee pivots, such opposite movements are impeded and the linkage under the weighted foot will act like a solid connection between the snowboarder's boot and snowboard body 12. Thus, the compressible linkages are interconnected by the solid rod in a manner so that the two linkages are impeded from non-uniform movements and movements in opposite directions, e.g., one linkage compressing while the other is extending is restricted.

Figure 11:
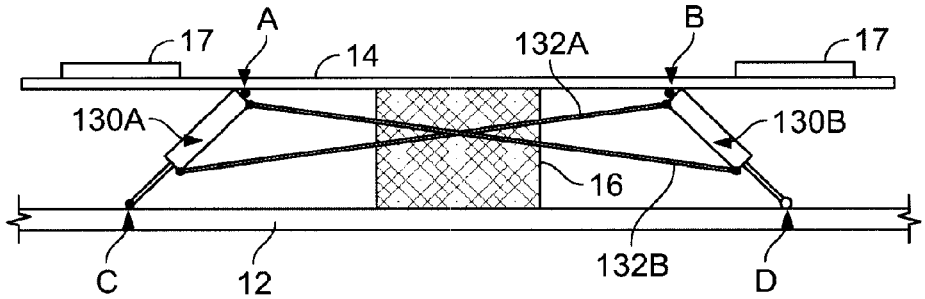

In another implementation, shown in FIG. 11, the knee pivots are replaced by two hydraulic piston/cylinder assemblies 130A, 130B located between the platform and body beneath each binding. The assemblies 130A, 130B are pivotally mounted to the platform at points A and B and to the snowboard body at points C and D. The compression chamber of each hydraulic cylinder is plumbed to the extension chamber of the other using a pair of hydraulic lines 132A, 132B. When both cylinders are in unison (balanced flex), they apply no impediment. However they present a near solid connection under one foot or the other when the platform is weighted unequally. In other words, the two cylinders can compress in unison or extend in unison without impediment, but they cannot move in opposite directions.

Figure 12:
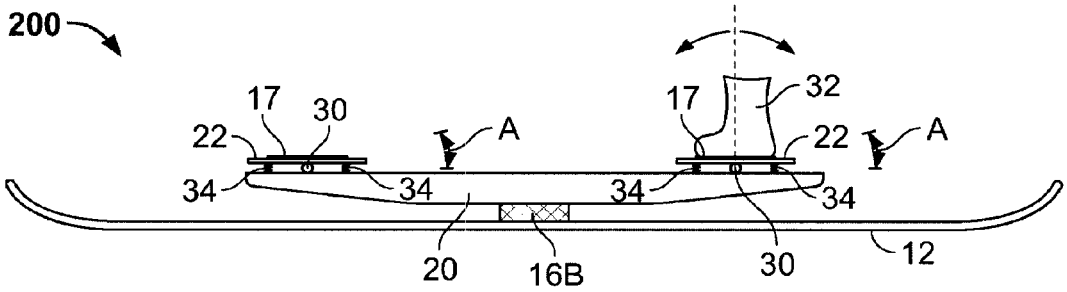
FIG. 12 is a diagrammatic side view of a snowboard according to another implementation of the invention, in which the snowboard bindings are allowed to cant.

In some implementations, the bindings are allowed to cant. In other words, each binding is mounted to the platform on a pivot that allows the binding to rotate about an axis parallel to the long axis of the snowboarder's foot. This rotation allows the snowboarder's knees to be angled slightly in or out. This movement could be free hinged, or spring-loaded so that the binding is biased towards a "normal" upright position but can be pressured to the left or right against the spring force. For example, referring to FIG. 12, snowboard 200 is similar in structure to the snowboard shown in FIG. 9C, except that foot pads 22 are pivotally mounted on hinge pins 30, allowing each foot pad to independently pivot (arrows A) about an axis that extends parallel to the long axis of the snowboarder's boot 32 (i.e., perpendicular to the plane of the paper in FIG. 12). The foot pads are biased to a normal, upright position by centering springs 34, positioned on either side of the hinge pin along the length of snowboard. Allowing the bindings to cant may give the snowboarder increased flexibility and/or leverage or reduce strain on the ankle during impacts. The snowboards described herein may also include a suspension system, to further enhance the ease and precision of turning. Suspension systems for skis are described in U.S. Ser. No. 60/630,033, filed Nov. 23, 2004, the full disclosure of which is incorporated herein by reference. These suspension systems allow a preload to be applied to the snowboard body, to maintain a minimum predetermined pressure on the tip and tail of the snowboard before significant bending and deflection begins. When deflection (and turning) begins, the tip and tail are already pressured sufficiently to carve a stable turn. Moreover, as will become apparent from the following discussion, with the suspension system, the weight of the snowboarder is distributed to three distinct points along the longitudinal length of the snowboard.

Figure 13:
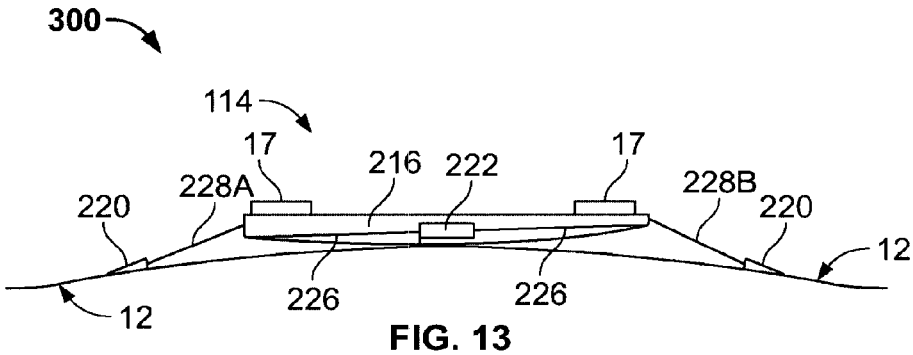
FIG. 13 is a side view of a snowboard including a suspension system according to one implementation of the invention.
Figure 14:
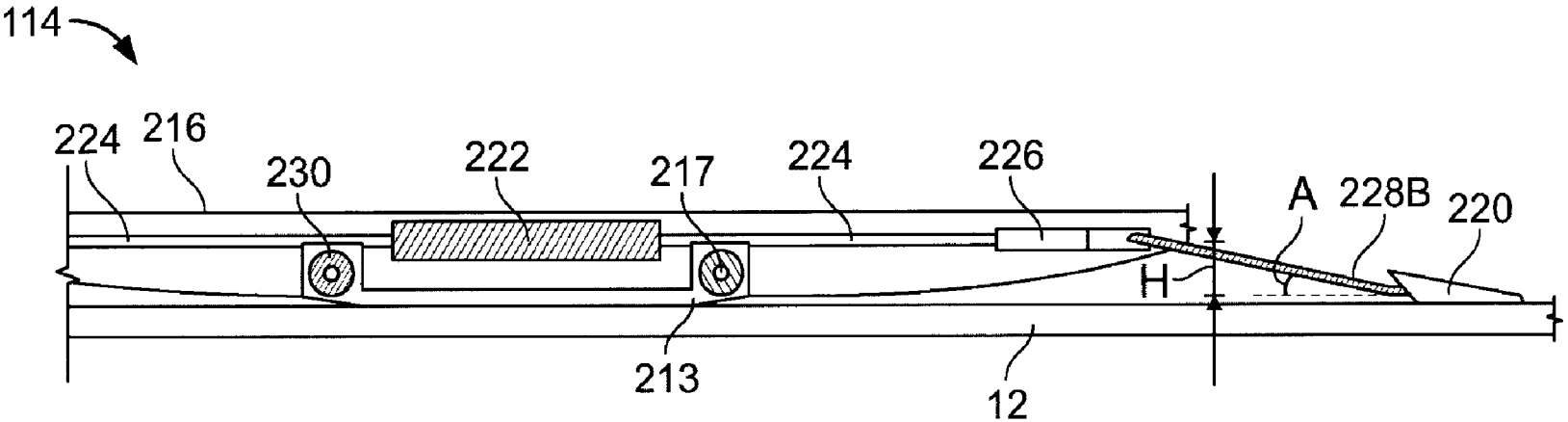
FIG. 14 is an enlarged side view of area A of FIG. 13.
Figure 15:
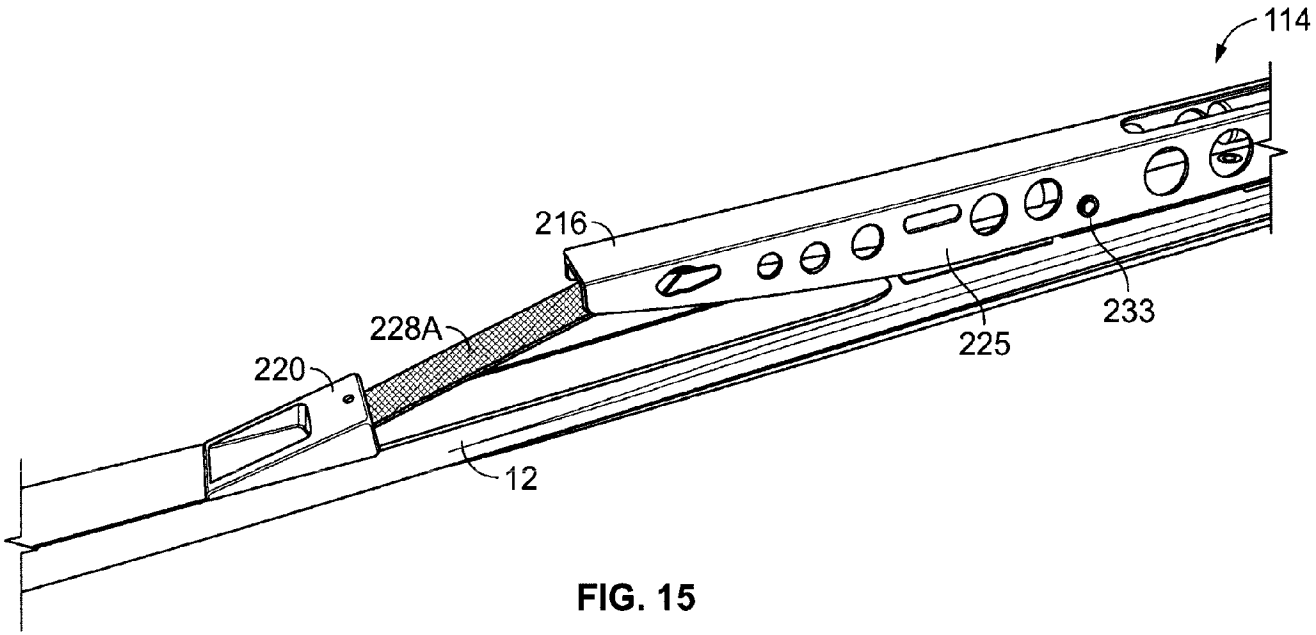
FIG. 15 is a perspective view of a front portion of the snowboard of FIG. 13.
Figure 15A:
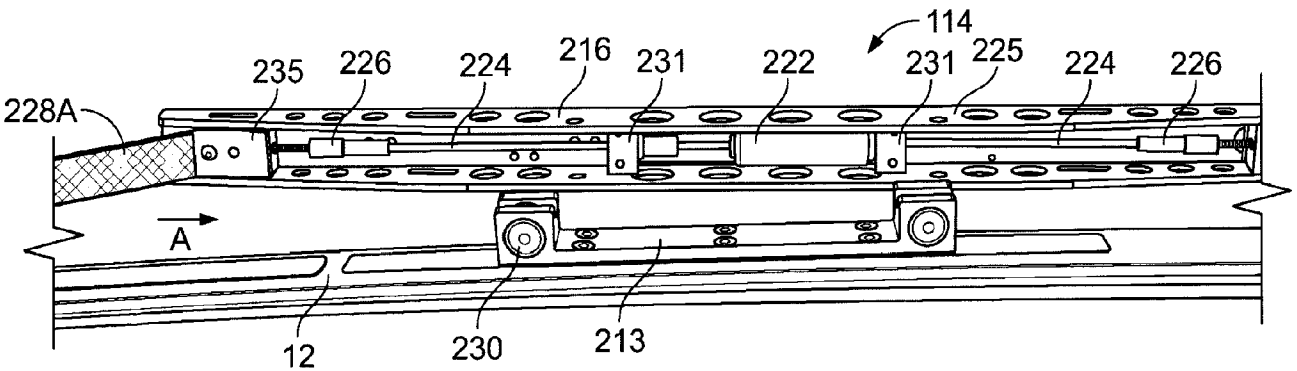
FIG. 15A is a partially exploded view, showing the beam/suspension/support assembly removed from the snowboard runner.
Figure 15B:
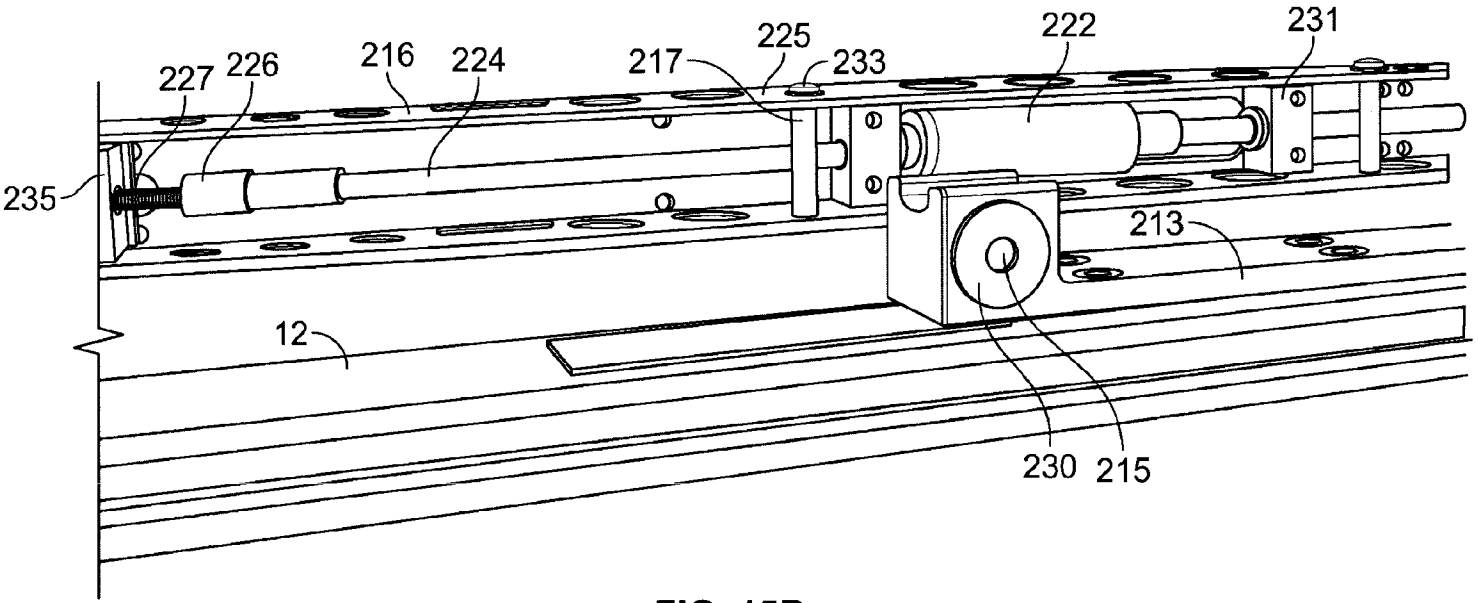
FIG. 15B is an enlarged view of a portion of FIG. 15A.

Referring to FIGS. 13-15B, snowboard 300 includes a snowboard body 12 as discussed above. (It is noted that only a small portion of the width of the snowboard body is shown in FIGS. 15-15B.) Snowboard 300 further includes a suspension system 114, described in detail below. The suspension system 114 is designed and constructed to optimize the spring rate of the snowboard, without spring rate being compromised in order to optimize the gliding/carving function or other characteristics of the snowboard. Thus, the gliding/carving function and the spring function of the snowboard are separated into two separate dedicated components (the snowboard body 12 and the suspension system 114).

Referring to FIGS. 14 and 15-15B, the suspension system 114 is housed in the substantially rigid support structure 216. The support structure 216 is connected to the snowboard body 12 through two resilient couplings 230 (FIGS. 15A, 15B) which may be formed, e.g., of an elastomer. Couplings 230, in conjunction with the mounting bracket 213, allow movement of the support structure 216 in two of three directions, but do not allow any significant relative yaw or roll between the support structure 216 and the snowboard body 12. The support structure 216 is attached to the snowboard body by pins 217 (FIG. 15B) each of which extends through a bore 215 (FIGS. 14A and 15B) in the resilient coupling 230. Resilient coupling 230 is held in bracket 213, which is in turn attached to or integral with the snowboard body 12. The pins 217 are internally threaded, and support structure 216 is screwed firmly to the pins 217 by screws 233 (FIG. 15B) which are threaded into the pins at each end (the screws are only visible on one side in FIG. 15B). The length of each pin corresponds exactly (within +0.005) to the outside width of the support structure 216, and thus each end of the pin is flush with the corresponding outer side wall 225 of the support structure 216. When the screws 233 are tightened down against the outer side walls, the engagement of the screw head with the side wall on each side of the support structure contributes to the structural integrity of the support structure, preventing the side walls from being spread apart by forces encountered during snowboarding.

This pinned attachment of the support structure 216 to resilient couplings 230 also allows the support structure 216 to be easily removed, allowing the assembly of the support structure and suspension system 214 to be removed and replaced by the user of the snowboard. This removability allows the user to interchange suspension systems having different performance characteristics, and also allows the user to remove the support structure/suspension system assembly to facilitate transport and storage of the snowboard and/or to prevent theft of the assembly. If desired, the screws 233 may be replaced by locking fasteners for which the snowboard owner has the key, reducing the likelihood of theft when the snowboard owner chooses not to remove the assembly from the snowboard at a ski area or other public place.

The support structure 216 maintains a close side-to-side tolerance with the bracket 213, which precludes any yaw and roll motion between the two parts. On the other hand, the resilient couplings 230 allow the pins 217, and thus the support structure 216, some damped movement up/down and fore/aft. This resilient suspension of the support structure 216 over the snowboard body 12 helps isolate the user of the snowboard from shocks and vibration. In an alternate implementation, the resilient couplings 230 can be eliminated and the pin 217 can pass directly through a clearance hole in bracket 213.

Figure 14A:
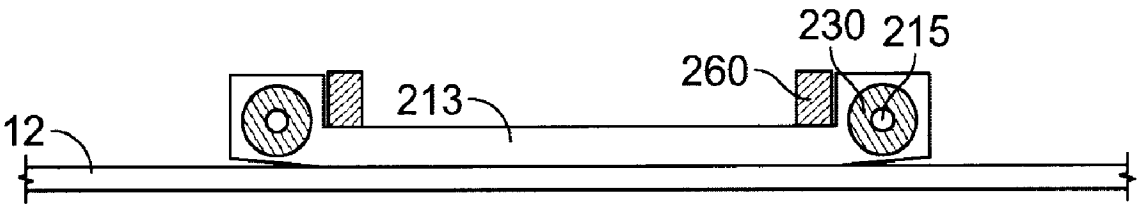
FIG. 14A is a side detail of a portion of FIG. 14.
Figure 16:
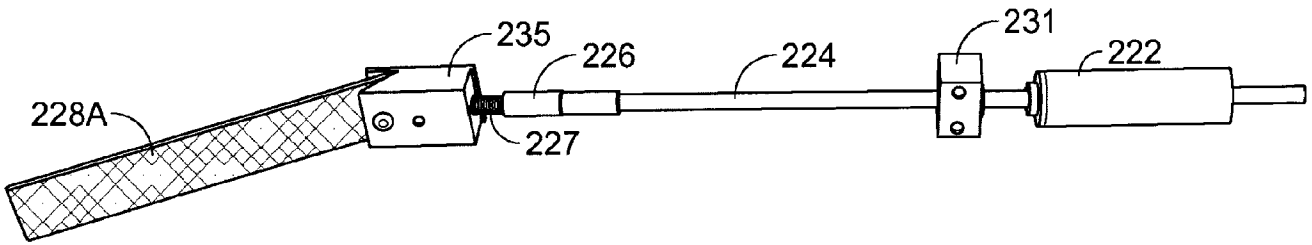
FIG. 16 is a perspective view of the rear half of the suspension sub-assembly.

In addition, as illustrated in FIG. 14A, elastomer elements 260 can be incorporated into bracket 213 that provide additional support to the structure 216. The support structure 216 carries a main spring 222. Main spring 222 is normally in a highly compressed state, typically in the 30 lb to 220 lb range. The spring may be, for example, a gas spring having a stroke of approximately 1-1.5 inches and a force ratio of approximately 1:1.4 from initial movement to end of stroke. For reasons of mass centralization and low moment of inertia, the spring 222 is typically located in approximately the center of the snowboard body 12. Referring to FIGS. 14, 15A and 16, the spring 222 is connected via shafts 224 and linkage 226 to the fore and aft struts 228A, 228B, which engage the snowboard body 12 through couplings 220 as will be discussed below. Each of the shafts 224 is supported by one or more support blocks 231 (while one block is shown in FIGS. 15A and 16, in some implementations each shaft is supported by two blocks, one at each end of the shaft) which are firmly mounted on support structure 216. As the front and back of the snowboard body 12 bend upwards into an arc, the couplings 220 push the struts 228A, 228B inwards into the support structure 216 (see arrow A, FIG. 15A), compressing the main spring 222 through the linkage 226 and shafts 224.

It is noted that the arrangement of struts 228, linkages 226 and shafts 224 relative to the snowboard body 12 may be configured so that the snowboard exhibits a diminishing spring rate beyond a certain degree of flexure. When the spring rate diminishes in this manner, the snowboard will perform more and more like a "soft" snowboard when the snowboard body is dramatically flexed. This reduction in spring rate is the result of struts 228, linkages 226 and shafts 224 becoming generally colinear as the snowboard is flexed. Once these components are colinear, the spring 222 will cease to apply any significant additional force to the tip and tail of the snowboard upon further flexure. How much the snowboard must be flexed before this colinearity occurs (if it does at all) can be predetermined by, for example, adjusting the angle A (FIG. 14) between the strut 228 and a line drawn from the base of the strut parallel to the upper surface of the snowboard body 12, and/or the height H of the point at which the strut is joined to the support structure 216 above this line. To provide good leverage to the snowboarder, it is generally preferred that H be at least 0.25", more preferably at least 0.5", and most preferably 1.0" to 1.5" Greater heights can also be effective. Angle A may be, for example, about 7 to 40 degrees, preferably about 10 to 20 degrees.

The linkage 226 can include adjustable elements that can be used to set the camber of the snowboard to any desired level. These adjustable elements allow the effective length of shafts 224 to be adjusted, thus pushing the tip and tail up or down via struts 228 and couplings 220, which decreases or increases "free camber" respectively. For example, as shown in FIGS. 15B and 16, the linkage 226 may include a threaded portion 227 that allows the length of shaft 224 to be adjusted by screw adjustment, i.e., by threading the threaded portion 227 of linkage 226 in and out of internally threaded block 235 at the end of strut 228. Under conditions where the terrain may be severely undulated, adjusting the snowboard to have additional camber allows the snowboard to bend into an exaggerated concave shape when the tip and/or tail would otherwise have become unloaded. This creates a 'long travel suspension' that will keep the tip and tail of the snowboard in contact with the snow for better control and stability.

Moreover, referring to FIGS. 13 and 14, in the suspension system 114 the fore strut 228A is connected to the aft strut 228B by the shafts 224, which both terminate at opposite ends of the single main spring 222. This independent but linked suspension will automatically equalize the spring load on both fore and aft struts. When the front of the snowboard is loaded, it will absorb much of the energy by compressing the suspension spring 22 to a higher pressure. Because of the continuous linkage, this same raised pressure is applied to the tail of the snowboard. The raised pressure on the tail of the snowboard helps keep the snowboarder balanced against the backward thrust while also keeping the tip down for continued control and stability.

This linked suspension system creates a unique sense of stability for the recreational snowboarder, absorbing and balancing forces that would normally be upsetting. Moreover, because the entire suspension/binding system assembly is resiliently mounted by couplings 30 (e.g., elastomer couplings) on the snowboard body (the running surface), vibrations and shocks directly underfoot are also effectively damped.

Figure 27:
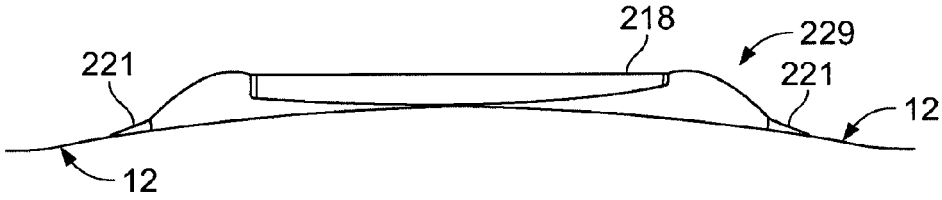
FIG. 27 is a side view of a snowboard that employs dual leaf springs.
Figure 28:
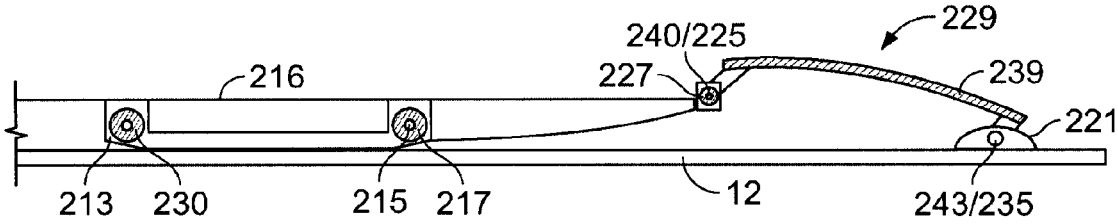
FIG. 28 is an enlarged view of a portion of FIG. 27.

An alternate implementation of this suspension system is shown in FIGS. 27 and 28. Similar to the previously described implementations, snowboard 10 is comprised of a snowboard body 12 with an attached mounting bracket 213 and leaf spring brackets 221. Referring to FIGS. 27 and 28, snowboard 10 is also similar to the previously described implementations in that it comprises a support structure 216, which mounts to the snowboard body 12 with pins 217 as discussed above.

In lieu of the centrally located main spring and linkages of the previously described implementations, the support structure 216 in this case comprises leaf spring mounting brackets 227 that are attached to both ends of the support structure 216, with the method of attachment allowing the location of the brackets 227 to be longitudinally adjustable by a small amount within the ends of the support structure 216 such as by having brackets 227 slide in or out within the support structure 216 after the bracket mounting screws have been loosened. Such longitudinal adjustment will increase or decrease the force of the leaf spring upon the snowboard body 12 at any specific deflection to compensate for differences in the weight of the snowboarder or changes in snow conditions.

Figure 29:
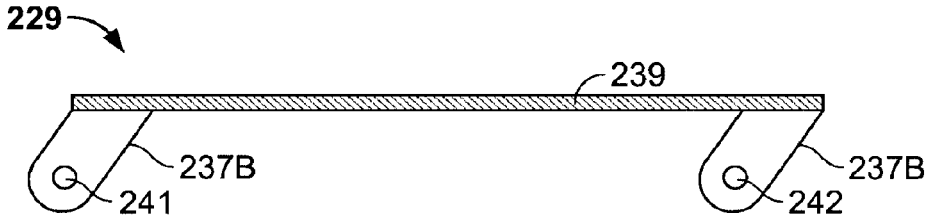
FIG. 29 is a side view of a leaf spring assembly.

FIG. 29 is an enlargement of one of the leaf spring assemblies 229, which consists of a resilient component 239 with attached mounting bosses 237A and 237B at each end. The resilient component 239 can be a composite of resin and fiber such as epoxy and fiberglass, carbon, or Kevlar, or a spring tempered metal. Each of the leaf spring assemblies 229 is connected at its opposite ends to the support structure and the snowboard body, for example using pins as shown in the figures. Thus, boss 237A of each leaf spring assembly 229 is connected to the support structure 216 by a pin 225, which passes through both a hole 240 in the leaf spring mounting bracket 227 and a corresponding hole 241 in the boss 237A. The other boss 237B is connected to the ski body 12 by a pin 235 that passes through both a hole 243 in the bracket 221 (FIG. 28) and a corresponding hole 242 in the boss 237B (FIG. 29). The pins 225 and 235 are drilled and tapped at both ends to accept screws that will retain the pins after insertion.

Snowboard 10 functions with the same performance characteristics and benefits of the previously described implementations because flexing of the body 12 into an arc compresses the leaf spring assemblies 229, creating a downward force on the snowboard body through brackets 221.

Figure 30:
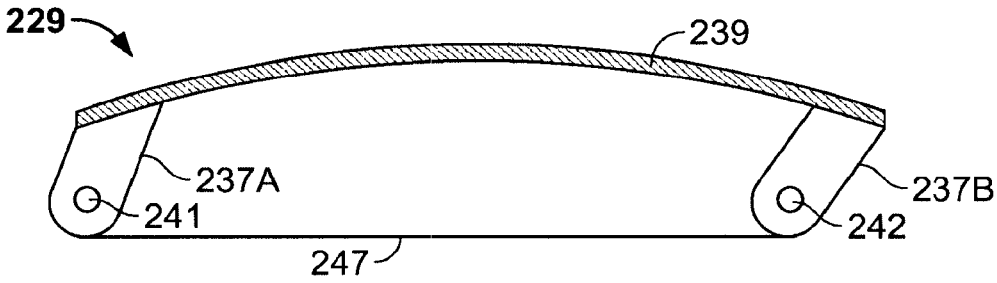
FIG. 30 is a side view of the leaf spring assembly of FIG. 29 with a pretensioner installed.

FIG. 30 is a side view of a leaf spring assembly 229' similar to that shown in FIG. 29, but with a preload tensioner 247 attached. The tensioner may be, for example, a stainless steel cable that is attached to the ends of bosses 237A and 237B while the leaf spring is held in a state of compression. The tensioner can also be a solid rod attached between the two bosses 237A and 237B in a manner that precludes the bosses from moving apart, but does not restrict the bosses from moving closer as when the leaf spring encounters additional compression. The tensioner can also be a rigid structure attached directly to the resilient component 239 while it is in the compressed state such that the resilient component is constrained to the minimum arc created by the compression but is free to arc further upon additional compressive force. When the compressive force is removed, the cable 247 or other restraining means prevents the bosses 237A and 237B from moving away from each other, keeping the resilient element 239 in a constant state of compression. When the leaf spring element 229' is installed in a snowboard similar to snowboard 10 shown in FIGS. 27 and 28, the snowboard will exhibit the preloaded characteristics previously described. The pretensioned leaf spring assembly 229' will preclude movement of the bracket 221 until the pretension force is exceeded. More importantly, the downward pretensioned force of the leaf spring assembly 229' is transferred to the snowboard body 12 by the bracket 221 even before the snowboard body experiences significant deflection. Such pretensioning typically creates a downward force on the snowboard body at each of the brackets 221 of between 7% and 16% of the skiers weight when the snowboard body is deflected to a longitudinally collinear shape, as when the snowboard is horizontal on a flat surface.

Figure 31:
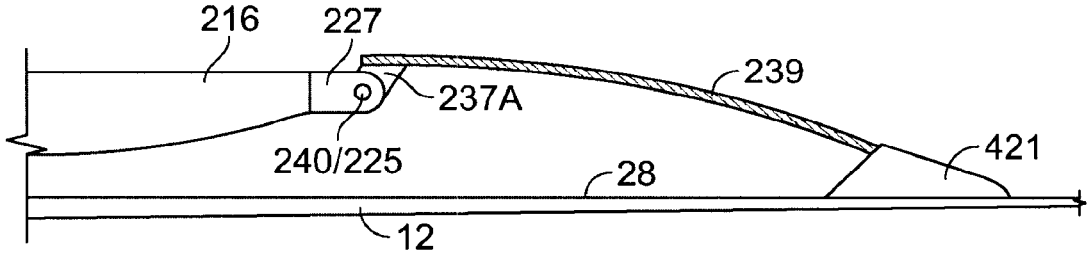
FIG. 31 is a side view of an alternate implementation of the dual leaf spring snowboard of FIG. 27 with an integral pretensioner.

An alternate implementation of this preload feature is illustrated in FIG. 31 where the bracket 221 with the hole 243 is replaced by bracket 421 to which the resilient component 239 directly attaches, eliminating pins 235 and bosses 237B. The bracket 421 is designed to hold the resilient component 239 at a specific angle relative to the top of the snowboard body 28, typically between 15 and 30 degrees. With this angle optimized, the resilient component provides all the desirable spring characteristics discussed above while the snowboard body 12 itself provides the restraining and pretensioning function eliminating the need for the pretensioning cable 247 or other specific pretensioning or restraining component.

Figure 17:
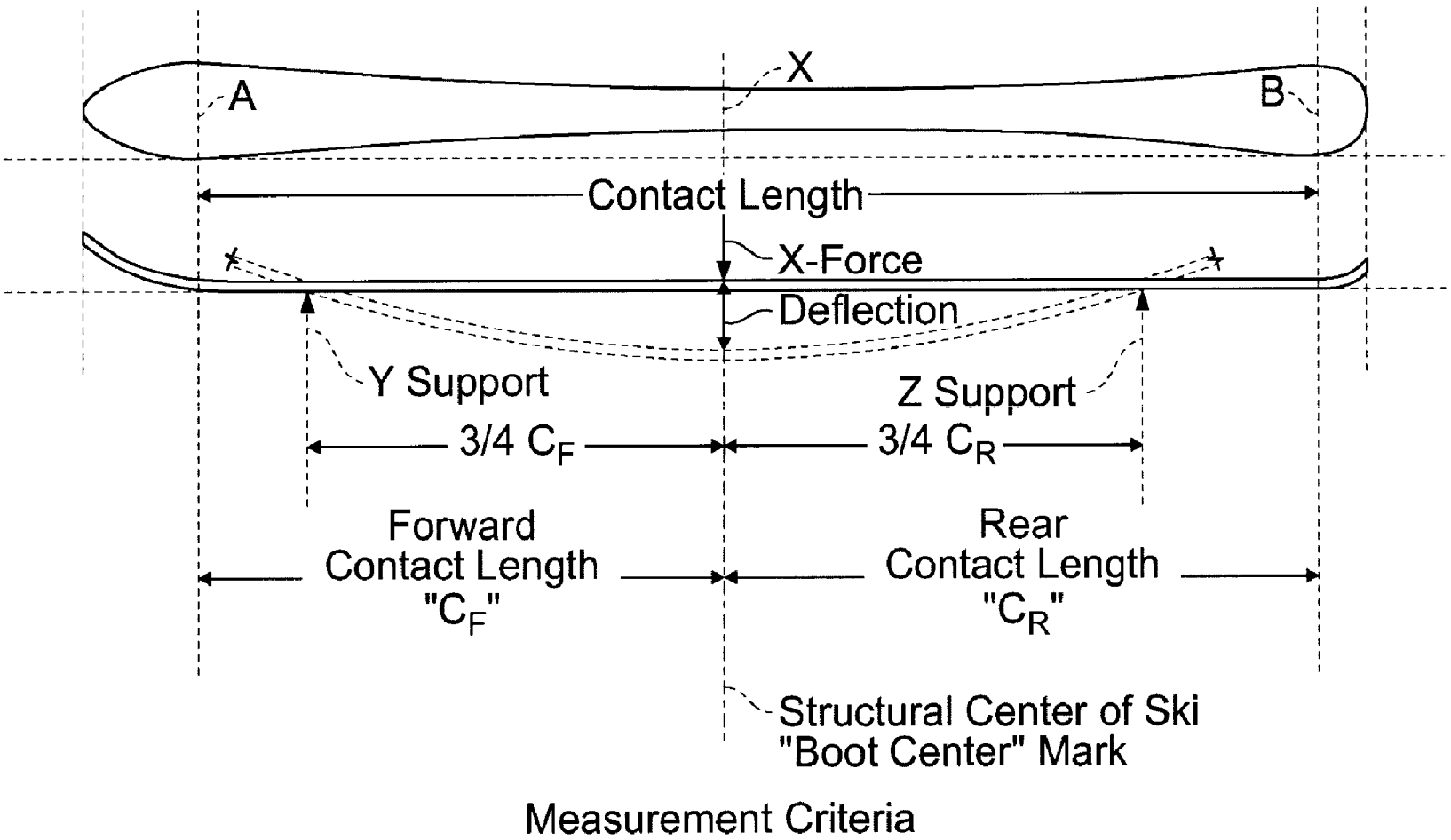
FIG. 17 is a graphic illustration of a measurement methodology used to measure the spring rate and preload of a ski or snowboard.

FIG. 17 illustrates a method used to measure the spring rate and preload of a ski having a suspension system. The same methodology would be used to measure the spring rate and preload of snowboards having suspension systems. Points A and B denote the points along the long axis of the ski at which the ski has its maximum width at the front and back of the ski respectively. These points typically coincide with the points at which the ski curls upward when its base is held against a flat surface. The distance between these points is the contact length of the ski, i.e., that portion of the ski that actually engages a hard snow surface. This distance is bifurcated at point X, the structural center of the ski, which is also denoted by the "boot center mark," the term often used to refer to the longitudinal center of a ski. The distances between X and A and between X and B are labeled "Forward contact length: CF" and "Rear contact length CR," respectively. During all measurements, the ski is supported at points Y and Z only, where point Y is ¾ of the distance CF forward of point X and point Z is ¾ of the distance CR behind point X.

Figure 1A:
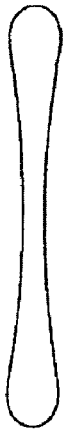
FIG. 1A Prior Art
FIGS. 1A and 1B are diagrammatic top views illustrating the shapes of a prior art ski and a prior art snowboard, respectively.
Figure 1B:
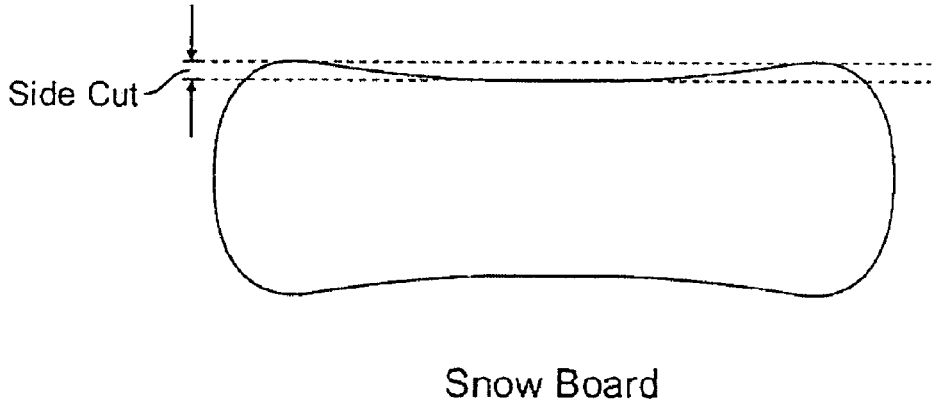
FIG. 1B Prior Art
Figure 2:
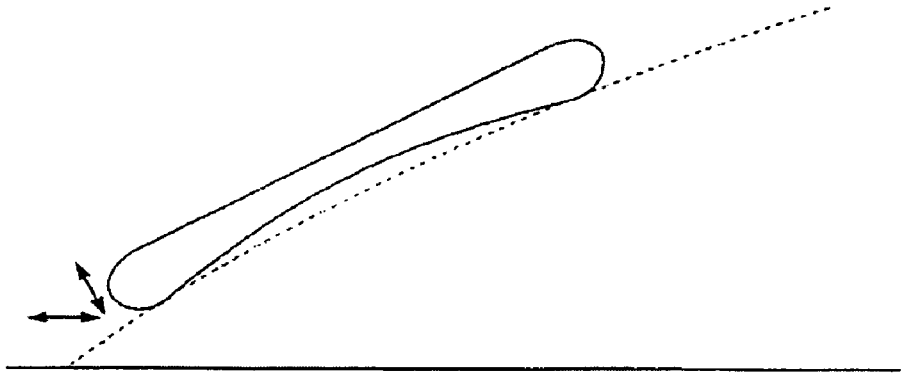
FIG. 2 Prior Art
FIG. 2 is a diagrammatic side view of the shape assumed by a conventional ski when it is being tipped on its edge by a skier (snow surface indicated in dotted lines, skier and binding omitted).
Figure 3A:
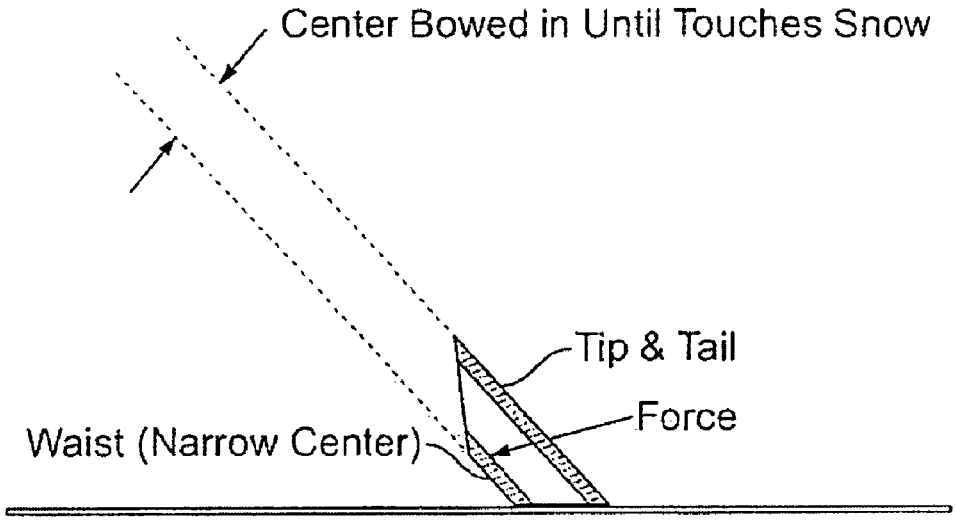
FIG. 3A Prior Art
FIGS. 3A and 3B are an end view and top view, respectively, of a conventional ski being bowed into an arc to make a turn.
Figure 3B:
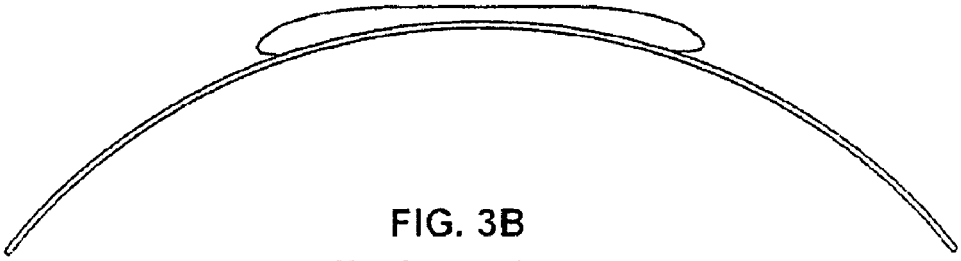
FIG. 3B Prior Art
Figure 4:
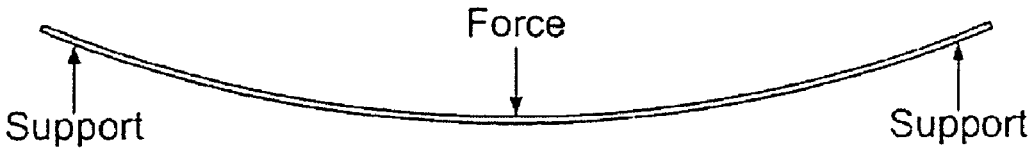
FIG. 4 Prior Art
FIG. 4 is a side view of a conventional ski with a force being applied to its longitudinal midpoint while its tip and tail are being supported.
Figure 5:
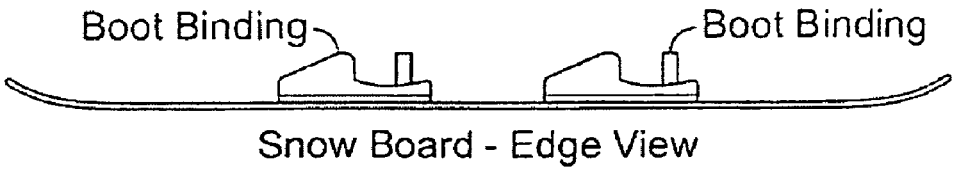
FIG. 5 Prior Art
FIG. 5 is a side view of a conventional snowboard.
Figure 5A:
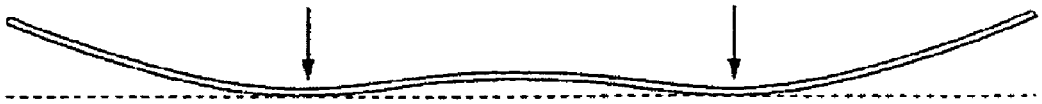
FIG. 5A Prior Art
FIG. 5A is a diagrammatic view showing where force is applied to the snowboard during turning and the shape that the snowboard tends to assume as a result.
Figure 6A:
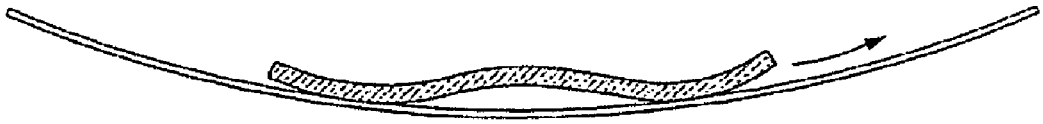
FIG. 6A Prior Art
FIG. 6A is a diagrammatic side view showing the profile that a conventional snowboard tends to assume during a turn.
Figure 6B:
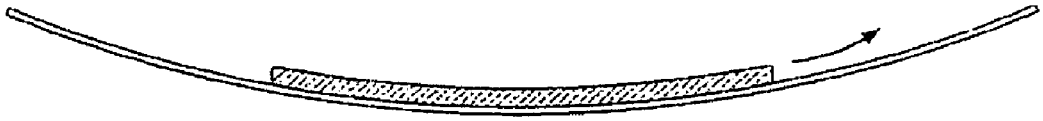
FIG. 6B Prior Art
FIG. 6B is a diagrammatic side view showing the theoretical profile that would result in a "perfect turn."

With the ski supported at points Y and Z, a downward force is applied at point X, which will result in the center of the ski bending downward between points Y and Z as shown in FIG. 3A. For a given force applied at X in this manner, the resulting downward displacement of point X from the initial position, with no force applied, to the position with the force applied, is referred to herein as deflection.

The principles discussed above may be utilized to provide snowboards having a variety of performance characteristics. For instance, the snowboard may exhibit a diminishing spring rate without an initial preload. This may be accomplished, e.g., by mounting the suspension system/support structure assembly discussed above on a snowboard body having a very low spring rate (i.e., a very "soft" snowboard body) and using a spring having a relatively low spring rate (e.g., a coil spring) in the suspension system. Thus, prior to flexing the snowboard, the coil spring will apply only enough force to the tip and tail to cause the snowboard to perform like a conventional snowboard having average stiffness. As the snowboard is flexed beyond a certain point the spring will apply less and less additional force to the tip and tail for equal increments of deflection, and thus the snowboard will perform more and more like a soft snowboard as it is flexed more and more dramatically.

Alternatively, or in addition, a "delayed" preload may be applied to the snowboard body. This may be accomplished, for example, by allowing a certain amount of flexure of the snowboard body before the spring of the suspension system is engaged, e.g., by using a telescoping strut that provides a small (e.g., 0.125") free play before the spring is engaged. The degree of flexure before the spring is engaged can be adjustable by the snowboarder if desired, e.g., by including with the telescoping mechanism a screw, detent or cam adjustment mechanism. This "delayed preload" may be desirable when the snowboard is to be used under icy conditions. The delay may be adjusted to such an extent that the preload may be delayed indefinitely, i.e., "turned off," when it is not desired. This feature may be useful during specific teaching exercises.

The main spring 222 can incorporate a quick-change feature, allowing it to be easily exchanged for an alternate main spring with a different preload and/or spring rate.

The struts 228A, 228B, which are normally in a state of substantially pure tension or pure compression, can be configured with a rotational moment that can apply an upward or downward force to the snowboard body 12 in addition to the tension/compression forces. This can be achieved through springs, torsion bars, and/or elastomers.

While the snowboard shown in FIG. 13 and described above facilitates optimized turning, for teaching beginners and other purposes for which a less sophisticated suspension system may be appropriate, snowboard 300, shown in FIG. 118A, presents a more economical approach.

Figure 18:
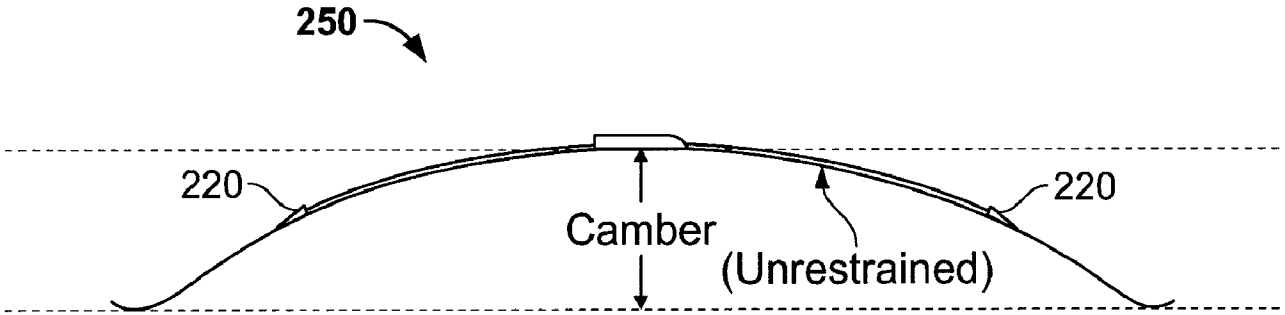
FIGS. 18 and 18A are side views of a snowboard according to an alternative implementation of the invention before and after mounting of a suspension structure onto the snowboard, respectively.
Figure 18A:
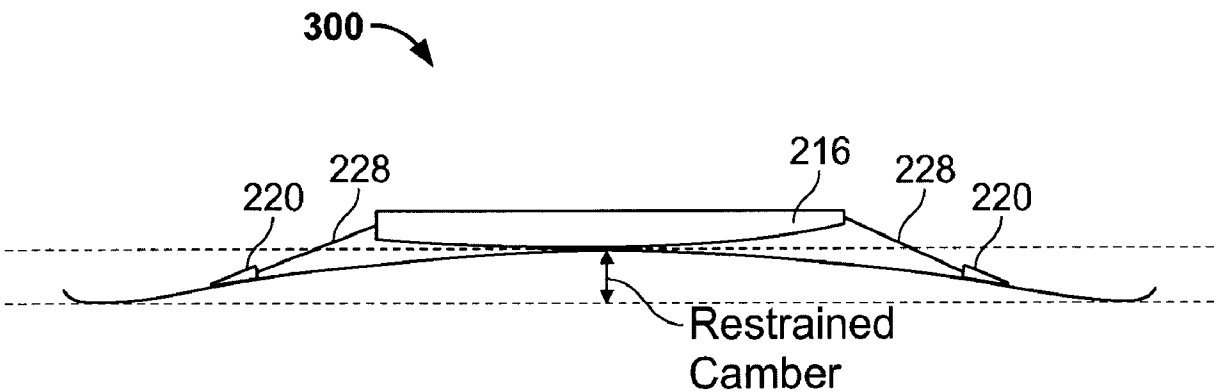

FIG. 18 shows a snowboard body 250 that is suitable for use in the snowboard 300 shown in FIG. 18A, before the spring suspension system and binding system are mounted. Snowboard body 250 is formed with an exaggerated free camber and a very low spring rate as compared to typical snowboard characteristics.

Once again, the support structure 216, carrying the restraining/suspension system 214 and the binding system 218, is coupled to the snowboard body 250 by bracket 213 and resilient couplings 230 that absorb shock and vibration while communicating precise yaw and roll control. For economical reasons, the resilient couplings could be eliminated and a direct attachment used, e.g., screws or bolts.

After the support structure 216 is in place on the snowboard body 250, the assembly is compressed against a flat surface until almost all the extreme camber has been sprung flat. In this constrained state, a profile view of the snowboard body would look like a conventional snowboard at rest, unloaded and uncompressed. While in this confined configuration, the two couplings 220 at the fore and aft of the snowboard body are engaged with corresponding linkages 228 on the suspension structure. Upon removal from the constraining apparatus (FIG. 18A), the snowboard 300 remains in the relatively un-cambered, stressed state, as the rigid support structure 216, by way of the fore/aft couplings 220, and struts 228, prevents the body 250 from returning to the extreme concave camber configuration as shown in FIG. 18. As such, this implementation exhibits a significant preload force and a low dynamic spring rate. This basic implementation can be manufactured using a relatively simple process. The beam 216 can be injection molded plastic and the linkage 228, because it is in tension only, can be a simple length of cable.

In other implementations, discussed below, the performance characteristics described above are provided by positioning the rider's feet directly on the board, and providing a suspension system that bends the middle of the board down to create a reverse camber. In these implementations, because the rider's feet are mounted directly on the board, without an intervening clearance, the rider can more easily twist the board by pushing down with the toe of one foot.

Figure 19:
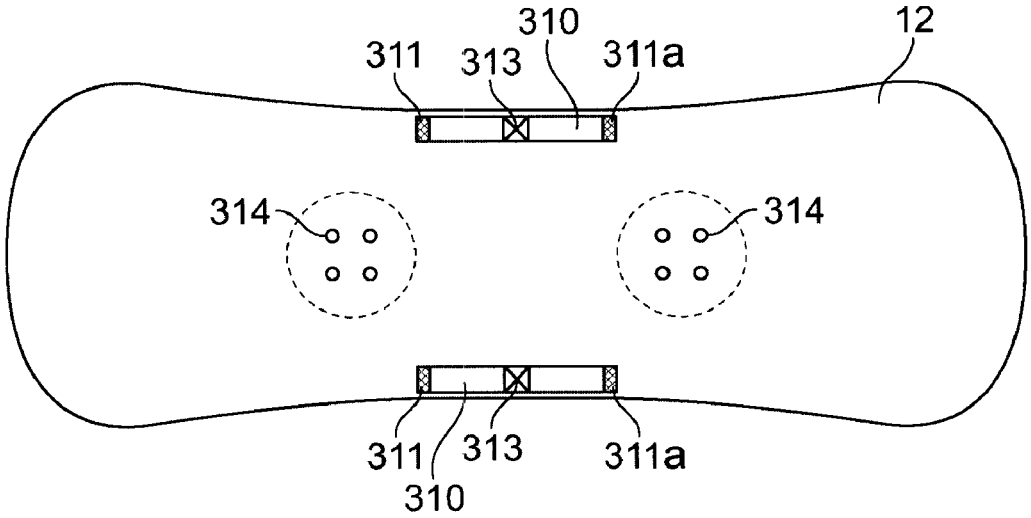
FIG. 19 is a diagrammatic top view of a snowboard incorporating a suspension system.
Figure 19A:
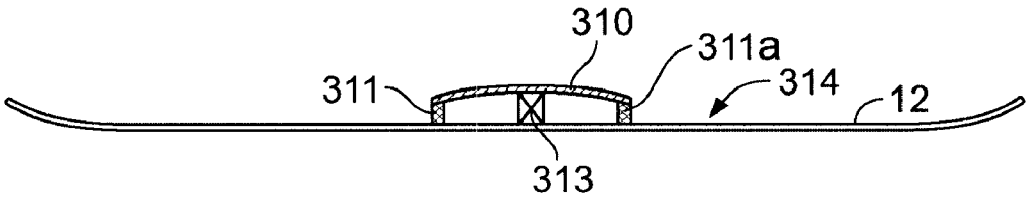
FIG. 19A is a diagrammatic side view of the snowboard shown in FIG. 19.

FIG. 19 is a diagrammatic top view and FIG. 19A is a diagrammatic side view of such a suspension system. The snowboard body 12 has a semi-rigid construction that will allow the board to flex into an arc when pressured into a turn. However, the construction and flex pattern differ from the typical construction and flex pattern of conventional snowboards. While a conventional snowboard is designed to have maximum stiffness and thickness at the longitudinal center, tapering toward the extremities, the body 12 of this snowboard is designed with approximately even thickness and stiffness for the entire distance between boot mounting positions. Moreover, in this implementation the maximum level of stiffness is typically less than that of a conventional snowboard, e.g., by about 5% to about 30%, because the beam and spring assume some of the support that the board itself would normally bear. As in the implementations described above, the body 12 also includes hard edges, e.g., of steel, around its perimeter. The preferred dimensions of the body are as discussed above.

The upper surface of the body 12 includes two mounting positions 314 for standard boot bindings, each located approximately at the lateral center and approximately 9 to 12 inches from the longitudinal center in opposite directions. The upper surface of the body also includes provision to structurally attach four mounting components 311, 311*a*, designed to retain the ends of two leaf springs 310. The two mounting components 311 retain one end of the leaf spring preventing movement in all three axes while components 311 a retain the other end of the leaf spring, so that vertical and lateral movement is prevented in two axes, with allowance for some movement in the longitudinal axis.

Figure 19B:
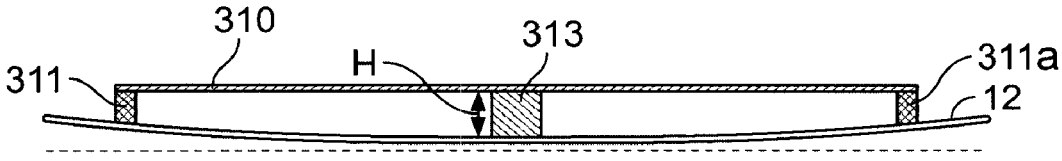
FIG. 19B is an enlarged view of the central portion of the snowboard shown in FIG. 19A.

The leaf spring 310 may be constructed of a laminated or compression molded composite or other suitable material such as spring tempered steel. Referring to FIG. 19B, leaf spring 310 is joined at each end to the mounting components 311, 311*a*. Two pressure blocks 313 fit between the snowboard body and the two leaf springs at the approximate longitudinal center of the body 12. The blocks can be attached to either the snowboard body 12 or the leaf spring 310, using reciprocal means of retention such as screws, quarter turn devices, retractable ball retention pins, or the like. The leaf spring 310 is designed, together with the dimensions of the block 313, to exert a compressive force on the block, depending on the weight of the rider and the performance criteria, of from 10 lb. to 130 lb. when the snowboard body is pressured flat on a hard surface by a rider. In practice, this will redistribute and redirect a significant portion of the rider's weight (typically from 25% to 50%) to a force in the longitudinal center of the board, allowing the board to easily arc into a turn when placed on edge.

The pressure blocks 313 may also include means to expand or contract the height dimension (H, FIG. 19B) and thus increase or decrease, respectively, the force being applied by the leaf spring 310 to the block 313 and snowboard body 12. Such dimensional change may be accomplished by any number of means, including, but not limited to, rotating cams, jack screws, and interchangeable shims.

FIG. 19B illustrates how the leaf spring pressure upon the block 313 forces the center of the snowboard body 12 into a reverse camber arc when the snowboard is angled on edge in a turn or is unweighted as when in the air from a jump. This reverse camber provides shock/energy absorption: upon landing, the reverse cambered center of the snowboard contacts the surface first, before the rider's feet, allowing the spring/suspension system to absorb a significant portion of the impact energy before the rider's feet touch the ground, thus cushioning the impact. This is especially effective with the gas shock described below.

Figure 20:
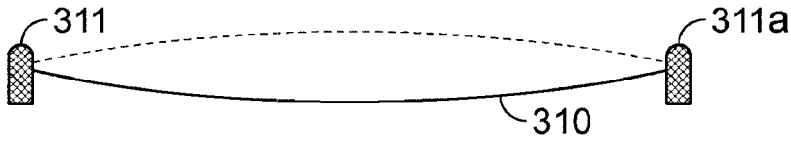
FIG. 20 is a diagrammatic side view of the leaf spring that is a component of the snowboard shown in FIGS. 19-19B.

FIG. 20 illustrates the leaf spring 310 unmounted, showing the natural camber that is built-in during manufacture. The dotted line above the leaf spring indicates the pressured state of the spring when the leaf spring is mounted on the snowboard and the snowboard is pressed flat by the rider.

Figure 21:
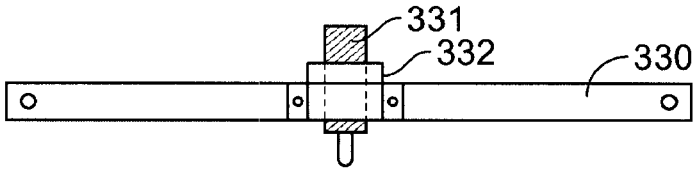
FIG. 21 is a diagrammatic side view of an alternate implementation.

FIG. 21 illustrates an implementation that substitutes a gas shock, gas spring, or coil spring for the leaf spring 310 described above. An essentially rigid beam 330 has dimensions similar to the leaf spring 10 and attaches to the snow board through similar mounting components 311, 311*a*. The beam typically would be fabricated of a light alloy (aluminum, titanium), composite, or engineering plastic. The beam will typically include means to increase or decrease its length. At the approximate center of the beam 330 is a mounting bracket 332 configured to accept a spring device 331 such as a gas shock, gas spring, or coil spring. The mounting bracket 332 includes provision for raising/lowering the spring 331 relative to the beam 330, as well as easily removing it altogether. This adjusts the amount of free camber the board will have when "unweighted". The extent of such an adjustment would depend on snow conditions (hard/powder) and maneuvers (boardercross/terrain park/big air). Additional means are included to lock the spring in position after the height has been adjusted. The spring devices would typically have a compressible travel of about one inch but for specific applications any desired travel may be used, for example from about ¼" to 2". Spring pressures at full compression-would generally fall into the range of about 10 lb. to 120 lb., depending on rider weight and desired characteristics.

The suspension system shown in FIG. 21 advantageously delivers a preloaded pressure to the center of the snowboard with a relatively low spring rate upon compression. The gas spring 331 exerts a predetermined force on the longitudinal center of each edge of the snowboard at full extension, for example, when the snowboard is in the air unloaded or arced into a severe turn. The gas spring becomes substantially compressed when the snowboard is flat, yet will exert a force typically only 30% greater than the predetermined force at full extension. For example, the predetermined force at full extension may be about 50 lb., in which case the force when the snowboard is flat may be about 65 lb. Depending on the desired characteristics, this system can redistribute to the center of the snowboard any percentage of the rider's weight, and maintain that percentage within a predetermined range over a range of snowboard positions from completely flat to a full arc (in the air or tight turn). The predetermined range is selected to provide a compliant, smooth suspension that keeps the support perceived by the snowboarder relatively constant over a wide range of snowboard deflection, and may be, for example, +/−12%.

Figure 22:
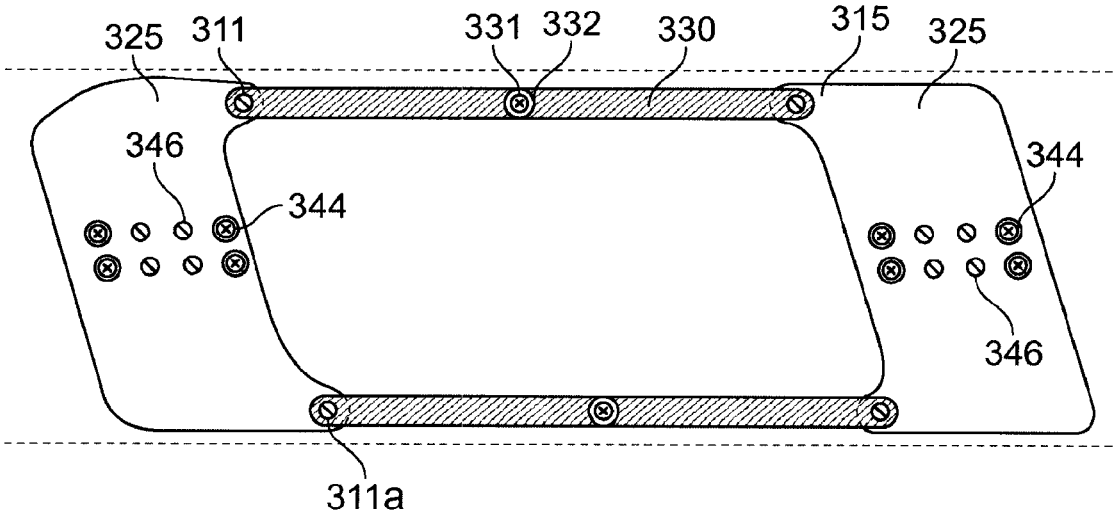
FIG. 22 is a diagrammatic top view of a suspension mounting system designed to attach to any standard snowboard.

FIG. 22 illustrates a suspension mounting system that is designed to attach to any existing conventional snowboard by attachment to the standard boot binding threaded inserts. The system includes two mounting plates 325 that each include countersunk screw holes 344 to allow the plates to be attached to the boot binding positions of any existing snowboard. The plates 325 are also drilled and tapped 346 for 6 mm screws in a standard pattern to accept conventional boot bindings. Thus, plates 325 are disposed between the snowboard body and the bindings when the suspension system is mounted on a snowboard. Plates 325 are preferably thin, i.e., less than 30 mm thick and preferably from about 8 to 20 mm thick.

Protruding laterally from the side of each plate 325 are brackets 315 with bosses 311, 311*a* to accept either of the suspension systems discussed above, i.e. the leaf spring 310 with pressure block 313 assembly, or the beam 330 with spring 331, 332 assembly.

After the plates 325 are screwed to the snowboard body and the beams 330 or leaf springs 310 are properly attached, and the gas spring 331 or pressure block 313, respectively, are installed, the total assembly functions virtually identically to the previously described snowboards in which the suspension system is integral with the snowboard body.

In some implementations, the plates 325 can be eliminated and the brackets 315 with bosses 311, 311*a* can be made integral with an otherwise standard boot binding. The beam 330 with spring 331 or the leaf spring with pressure block 313 attaches to the bosses 311, 311*a* in the same manner with the same effect.

Figure 23:
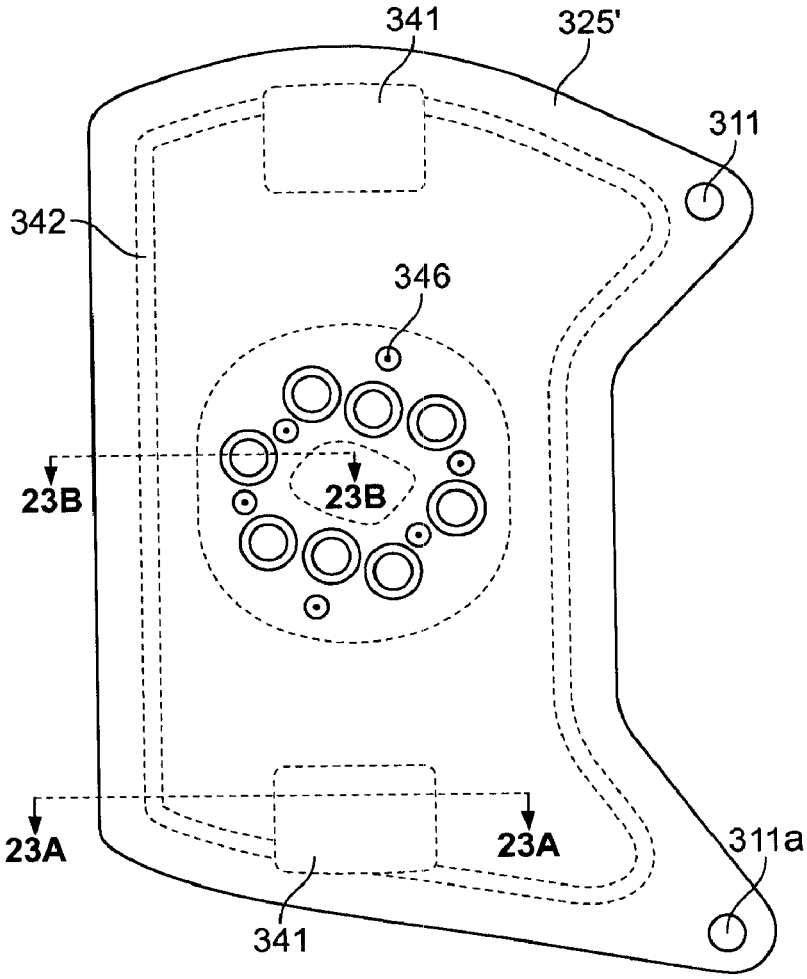
FIG. 23 is a diagrammatic top view of a suspension mounting plate according to an alternate implementation.
Figure 23C:
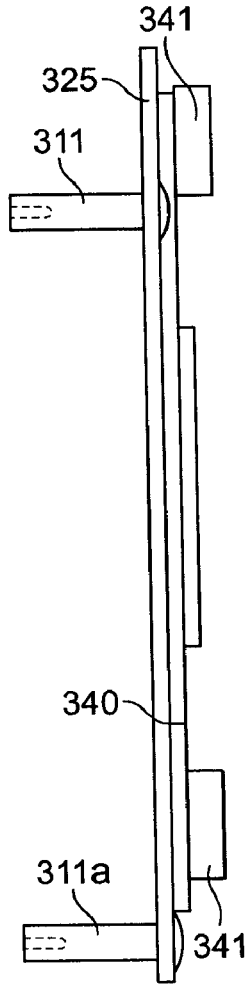
FIG. 23C is a side view of the plate shown in FIG. 23.

FIGS. 23-23C illustrate an alternate mounting plate 325'. Plate 325' includes the mounting holes 344 and 6 mm threaded holes 346, as well as the bosses 311, 31*a*, as described above.

Figure 23A:
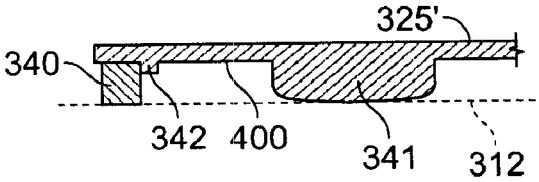
FIGS. 23A and 23B are diagrammatic cross sectional views of the suspension mounting plate shown in FIG. 23, taken along lines A-A and B-B, respectively.
Figure 23B:
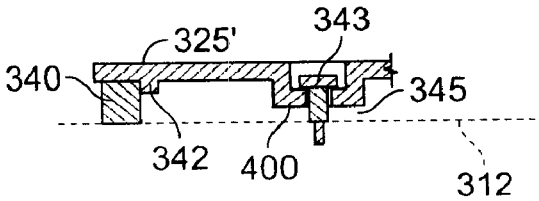

Referring to FIG. 23B, the plate 325' may be attached to a snowboard body using special 6 mm shoulder screws 343 or similar means. A circumferential ring 342 is molded into the lower surface of the plate to locate and retain an elastomer ring 340, which becomes partially compressed when the mounting screws 343 are tightened. This elastomer stabilizes the plate 325' and keeps snow from entering the cavity between the snowboard body 12 and the plate 325'. The lower surface 400 of plate 325' is configured to create a clearance distance 345 between the plate 325 and the snowboard body 12 after the screws 343 are tightened. The clearance 345 can be as little as 1 mm or as great as 25 mm, with 3 mm being typical.

Referring to FIG. 23A, the lower surface 400 includes pressure redistribution protrusions 341, which barely contact the snowboard body when screws 343 are fully tightened. The protrusions 341 are positioned to contact the snowboard directly above the edges when pressured by the rider, and the remainder of the plate is kept from contacting the snowboard directly by the clearance 345 and elastomer 340. As a result, the pressure of the rider's feet are redirected directly to the edges of the snowboard creating superior control and response. The clearance 345 and elastomer 344 also allow the snowboard body to naturally and freely torque in response to rider input, uninhibited by the boot binding and plate and structure, and pivot under the plate 325' about an axis parallel to the toe/heel axis of the rider's foot. With this system, the board is free to flex underneath the rider, yet his legs remain in the natural position because the plate can rotate on the toe/heel axis relative to the board. This is a very desirable feature during maneuvers where a rider pressures the toes on one foot and the heel on the other. In addition, the clearance 345 and the convex shape of the bottom of the protrusions 341 allow the snowboard body to freely bend into a pure arc when carving a turn, unimpeded by the structure of the boot bindings or side forces from the rider's feet and legs.

Figure 7:
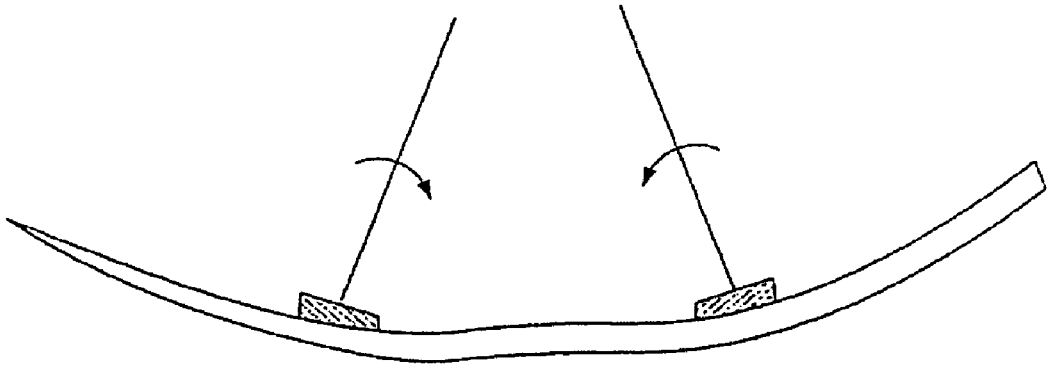
FIG. 7 Prior Art
FIG. 7 is a diagrammatic side view showing the angulation of a snowboarder's legs during a turn using a snowboard.

An otherwise standard boot binding can be fabricated with all the features described in FIGS. 23A-23C included as an integral part. In this case, a separate plate 325' is eliminated and the functionality of plate 325' is incorporated into the bottom of the boot binding, complete with the protrusions 341, elastomer 340, mounting holes 344, and mounting clearance 345. Such a boot binding can be fitted with the brackets 315 and bosses 311, 311*a*, and can accommodate the beams 330 with springs 331 or the leaf spring 310 with pressure block 313 as discussed above. Accordingly, the boot binding will function in subsequently the same manner as the systems shown in FIGS. 7-9 as discussed above.

Figure 24:
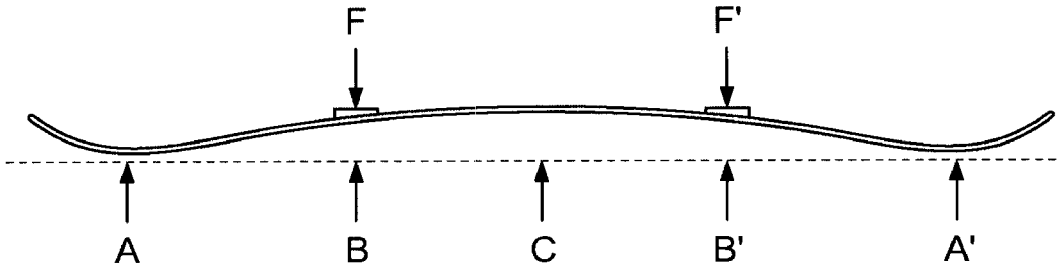
FIG. 24 (Prior Art)
FIG. 24 is a diagrammatic side view of a conventional snowboard illustrating the standard positive camber that creates a concave arc when the board is on a flat hard surface. The extremities of the running surface longitudinally contact the surface while the center is suspended above the surface.

FIG. 24 is a diagrammatic side view of a conventional snowboard body showing the normal camber from front to back along the longitudinal axis. The center of the snowboard is raised relative to the two ends of the running surface. Such a snowboard placed flat on hard snow will contact the snow at A and A' only, with C held suspended above the snow surface.

When a rider stands on the board, the force of body weight is applied at the boot binding positions as indicated by F and F'. The initial force upon the snow will occur at points A and A' where the board is contacting the snow. As the applied force flattens the camber, the force on the snow will spread from A and A' inward toward B and B' respectively. The predominant force of the rider's weight will thus be supported by the snow in the areas between A and B, and A' and B' respectively. The least amount of force exists at C, and thus the snowboard exerts minimal pressure on the snow at this central region. This force distribution counter productive to the method by which a snowboard is meant to turn and maneuver, which mandates maximum pressure in the center of the board in order to bend it into an arc against the forces created by the wide extremities of the running surface.

Figure 25:
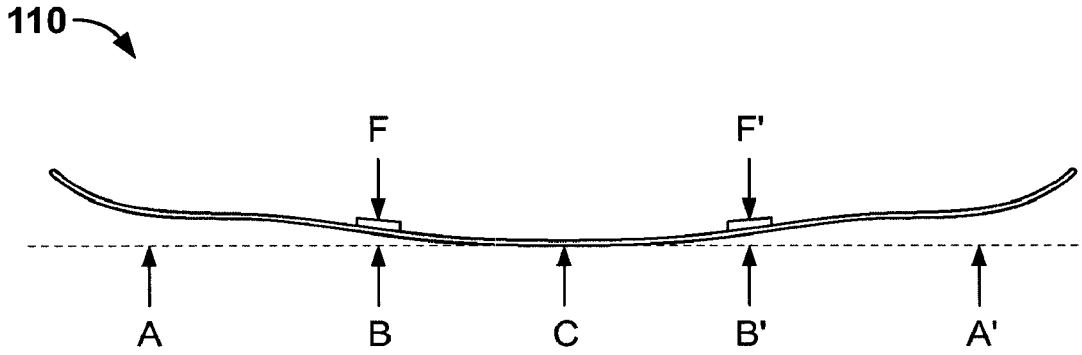
FIG. 25 is a diagrammatic side view of an implementation that employs a novel longitudinal reverse camber contour molded into the body of the snowboard.

FIG. 25 is a diagrammatic side view of a snowboard body 110. Instead of the normal camber as depicted in FIG. 24, the snowboard body 110 is molded with a novel lower surface that exhibits the opposite contour, i.e., a 'reverse camber'. When placed flat on a hard snow surface, the snowboard body 110 will only contact the snow at C, while A-B and A'-B' remain raised above the snow surface. As the rider applies the force at F and F', the initial pressure upon the snow will be at C and then at A and A'; after which it will spread to B and B'. The weight of the rider is supported by the snow along the entire running surface of the snowboard including the center at C. Depending on the initial contour and amplitude of the reverse camber, a significant portion of the rider's weight can be applied to the center of the board, allowing the snowboard to efficiently bend into an arc for turning.

Like the snowboards described above, snowboard body 110 it has a lower surface that is constructed to slide over a snow surface, formed, for example, of high density polyethylene (HDPE), a blend of HDPE with graphite, or other hard materials having a relatively low coefficient of friction. The body 110 has a semi-rigid construction that will allow the board to flex into an arc when pressured into a turn, and includes hard edges, e.g., of steel, around its perimeter. The preferred dimensions of the body are as discussed above.

Figure 26:
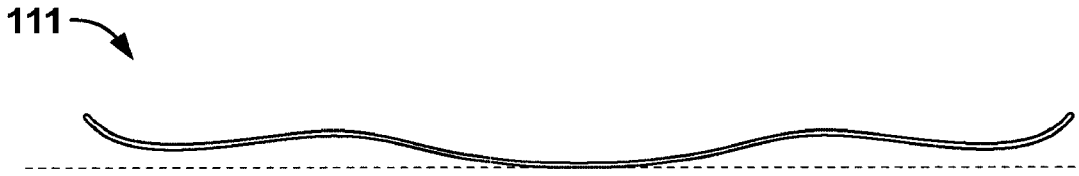
FIG. 26 is a diagrammatic side view of a snowboard in which the longitudinal contour exhibits positive camber toward the extremities of the board in addition to the central reverse camber.

FIG. 26 illustrates a body 111 having one of many possible bottom contours that exhibit a reverse camber in the center but exhibit variations in contour at the extremities to create alternate performance characteristics.

This molded reverse camber snowboard body can be economically produced in quantity while effectively maintaining one of the major advantages of the invention, which is distributing a greater portion of the rider's weight to the desirable center region of the snowboard as compared to a conventionally molded snowboard.

When spring rate is measured as discussed above with reference to FIG. 17, the snowboards discussed above that include the preload spring will exhibit a novel spring rate curve where the spring rate will be greatest for the first increment of displacement (0 to 5 mm) with subsequent 5 mm increments having a significantly lower spring rate. Generally, the force required to create the first 5 mm of displacement will be at least 10% greater than that additional force required for an additional 5 mm of displacement, and the force required to create 10 mm of displacement will be less than 1.9 times that required for the first 5 mm of displacement.

A number of implementations of the invention have been described. Nevertheless, it will be understood that various modifications may be made without departing from the spirit and scope of the invention.

For example, means can be incorporated into the couplings 220 and/or struts 228, and/or into the support structure 216, that would allow the amount of camber to be easily adjusted. By lengthening or shortening the effective length of the restraining struts 228, the body 250 can be allowed to bend more or less in the unloaded state. Thus the static camber can be adjusted over a wide range from that of a conventional snowboard to an extremely long-travel concave shape, which improves the carving ability dramatically. A snowboarder typically shifts weight to the rear foot to power out of a carved turn. Unfortunately this makes the front of the snowboard light and it can lose grip and skid. The long travel suspension keeps the front of the snowboard in contact with the snow even when the back of the snowboard is inordinately weighted.

Moreover, additional components, such as elastomers or springs can be employed in or between couplings 220, struts 228, and support structure 216 to augment or modify the dynamic characteristics. For example, incorporating an elastomer where each strut 228 is joined to either support structure 216 or coupling 220 would damp the suspension upon full extension as in a situation when the skier leaves the snow surface momentarily.

An alternate version of this implementation uses cables as the coupling members that limit the camber and create the preload force (i.e., struts 228 may be replaced by cables). Camber adjusters and spring tensioners can also be used in this system to adjust the camber and preload.

In another alternate implementation, elements of the two previously described implementations can be combined. Thus, the snowboard shown in FIG. 13 can be modified to include a low spring rate body that has extreme concave camber in the unrestrained state. In such a case, the struts and couplings, together with the linkage and support structure, perform the restraining function (tension/unloaded) as well as the preload function (compression/loaded) as described above.

Accordingly, other implementations are within the scope of the following claims.

What is claimed is:

1. A snowboard comprising:

a snowboard body, having an upper surface and a lower surface, the lower surface being constructed to slide on snow, the snowboard body having a width of at least 9 inches and a length of at least 4 feet; and mounted on the upper surface of the snowboard body, a boot binding mounting and suspension system comprising a generally horizontal mounting platform defining two boot/binding mounting locations each for attachment to a boot binding, wherein each boot binding is adapted to receive and secure a snowboarder's boot to the mounting platform within that boot/binding mounting location during use, the boot binding mounting and suspension system fixedly attached to a longitudinally central location of the snowboard body in a cantilevered manner that maintains a clearance distance between the mounting platform and the snowboard body in the area under each of the two boot/binding mounting locations, each boot/binding mounting location being on opposite sides of the longitudinally central location;

a spring suspension system comprising a spring in a compressed state when the snowboard is free of external forces, the spring applying a force to at least one longitudinal end of the snowboard, wherein the spring suspension system is configured to provide the snowboard with a spring rate that diminishes at least 10% as the snowboard is flexed from a normal unloaded state or a predetermined state of deflection to a state of higher deflection.

* * * * *